US011156006B2

(12) United States Patent
Hatch et al.

(10) Patent No.: US 11,156,006 B2
(45) Date of Patent: Oct. 26, 2021

(54) BASEBOARD ELEMENTS AND RELATED METHOD

(71) Applicants: William Michael Hatch, Peoria, AZ (US); Phil De La O, Jr., Glendale, AZ (US)

(72) Inventors: William Michael Hatch, Peoria, AZ (US); Phil De La O, Jr., Glendale, AZ (US)

(73) Assignee: SAS IP, LLC, Peoria, AZ (US)

( * ) Notice: Subject to any disclaimer, the term of this patent is extended or adjusted under 35 U.S.C. 154(b) by 0 days.

(21) Appl. No.: 16/818,871

(22) Filed: Mar. 13, 2020

(65) Prior Publication Data

US 2020/0217088 A1 Jul. 9, 2020

Related U.S. Application Data

(63) Continuation of application No. 15/263,132, filed on Sep. 12, 2016, now Pat. No. 10,648,185, which is a (Continued)

(51) Int. Cl.
*E04F 19/02* (2006.01)
*E04F 13/00* (2006.01)
(Continued)

(52) U.S. Cl.
CPC ..... *E04F 19/061* (2013.01); *E04F 19/02* (2013.01); *E04F 19/022* (2013.01);
(Continued)

(58) Field of Classification Search
CPC ..... E04F 13/00; E04F 13/002; E04F 13/07; E04F 13/0869; E04F 13/0864;
(Continued)

(56) References Cited

U.S. PATENT DOCUMENTS 3,158,960 A 12/1964 Newton et al.
3,188,772 A 6/1965 Tennison, Jr.
(Continued)

FOREIGN PATENT DOCUMENTS

| | | |
|---|---|---|
| CN | 202915027 U | 5/2013 |
| JP | 4611133 | 1/2011 |
| WO | 199410404 | 5/1994 |

*Primary Examiner* — Phi D A

(74) *Attorney, Agent, or Firm* — Bryan Cave Leighton Paisner LLP

(57) ABSTRACT

A baseboard element including a nose portion, a riser portion, and a wall groove portion coupled to the riser portion. The nose portion includes a nose bottom section and a nose face section. The riser portion includes a riser section extending approximately perpendicular to the nose bottom section and a riser bend coupled to the nose portion. The riser section is substantially planar and defines a plane. The nose portion is positioned only on a first side of the plane defined by the riser section, and the wall groove portion is positioned only on a second side of the plane, the second side opposite the first side. The nose bottom section comprises a nose bottom edge at a terminal end of the nose bottom section. No structure of the baseboard element extends beyond the terminal end of the nose bottom section from the terminal end. The nose bottom edge of the nose bottom section is either approximately at the plane or closer to the plane than the nose face section is to the plane. Other embodiments are also provided.

20 Claims, 21 Drawing Sheets

Related U.S. Application Data continuation-in-part of application No. 14/313,991, filed on Jun. 24, 2014, now Pat. No. 9,441,381.

(51) Int. Cl.

| | |
|---|---|
| ***E04F 13/08*** | (2006.01) |
| ***B21D 5/16*** | (2006.01) |
| ***E04F 19/06*** | (2006.01) |
| ***E04F 19/04*** | (2006.01) |
| *E04F 13/072* | (2006.01) |
| *E04F 13/07* | (2006.01) |

(52) U.S. Cl.

CPC ..... *E04F 19/0436* (2013.01); *E04F 19/0486* (2013.01); *B21D 5/16* (2013.01); *E04F 13/07* (2013.01); *E04F 13/072* (2013.01); *E04F 2019/0413* (2013.01)

(58) Field of Classification Search

CPC ..... E04F 13/0889; E04F 13/12; E04F 13/088; E04F 19/061; E04F 19/02; E04F 19/046; E04F 2019/0413; E04F 2013/065; E04F 13/072; E04F 13/08; E04F 13/0835; E04F 13/0887; E04F 13/26; B21D 5/16

See application file for complete search history.

(56) References Cited

U.S. PATENT DOCUMENTS

| | | | | |
|---|---|---|---|---|
| 3,237,352 | A | 3/1966 | Edwards | |
| 3,242,622 | A | 3/1966 | Snead | |
| 3,735,538 | A | 5/1973 | Ramins | |
| 4,663,906 | A | 5/1987 | Weinar | |
| 4,809,479 | A | 3/1989 | Tierno | |
| 4,825,601 | A | 5/1989 | Halverson | |
| 5,090,174 | A | 2/1992 | Fragale | |
| 5,426,898 | A | 6/1995 | Larsen | |
| 5,560,170 | A | 10/1996 | Ganser | |
| 5,791,093 | A | 8/1998 | Diamond | |
| 5,813,179 | A | 9/1998 | Koenig, Jr. et al. | |
| 5,819,490 | A | 10/1998 | Current | |
| 5,836,113 | A | 11/1998 | Bachman | |
| 5,944,203 | A | 8/1999 | Vlah | |
| 5,956,914 | A | 9/1999 | Williamson | |
| D432,671 | S | 10/2000 | Grosfillex | |
| 6,186,605 | B1 | 2/2001 | Nelson | |
| D443,073 | S | 5/2001 | Wilson | |
| D489,832 | S | 5/2004 | Koenig, Jr. | |
| 6,802,161 | B1 | 10/2004 | Robinson | |
| D528,669 | S | 9/2006 | Zarb | |
| 7,487,623 | B2 * | 2/2009 | Rodolofo | E04D 13/152 52/288.1 |
| D599,916 | S | 9/2009 | Polston | |
| 7,823,336 | B2 | 11/2010 | Brochu et al. | |
| 8,104,234 | B1 | 1/2012 | Sawyer | |
| 8,468,767 | B1 | 6/2013 | McBride | |
| 8,495,844 | B1 | 7/2013 | Johnson, Sr. | |
| 8,661,751 | B1 | 3/2014 | Lawrie et al. | |
| D740,968 | S * | 10/2015 | Stanfill | E04F 13/0862 D25/119 |
| 9,481,321 | B2 | 11/2016 | Fisher | |
| 10,011,995 | B2 * | 7/2018 | Monteer | E04F 13/0862 |
| 10,024,064 | B2 * | 7/2018 | Monteer | E04F 13/18 |
| D853,589 | S * | 7/2019 | Jackson | E04F 3/0862 D25/119 |
| 2001/0039774 | A1 | 11/2001 | Beirise et al. | |
| 2002/0124485 | A1 | 9/2002 | Pulte | |
| 2003/0037495 | A1 | 2/2003 | Shaw | |
| 2003/0121217 | A1 * | 7/2003 | Grizenko | E04D 13/1478 52/60 |
| 2003/0213195 | A1 | 11/2003 | Mathis et al. | |
| 2005/0257443 | A1 | 11/2005 | Lin | |
| 2007/0199269 | A1 | 8/2007 | Mees | |
| 2008/0005986 | A1 | 1/2008 | Thompson | |
| 2008/0295439 | A1 | 12/2008 | Janesky | |
| 2009/0056252 | A1 | 3/2009 | Taylor | |
| 2009/0139167 | A1 | 6/2009 | Donaldson | |
| 2011/0179733 | A1 | 7/2011 | Picken | |
| 2012/0102849 | A1 | 5/2012 | Shugart | |
| 2013/0255171 | A1 | 10/2013 | Rutherford | |

* cited by examiner

BASEBOARD ELEMENTS AND RELATED METHOD

CROSS-REFERENCE TO RELATED APPLICATIONS

This application is a continuation of U.S. patent application Ser. No. 15/263,132, filed Sep. 12, 2016, which is a continuation-in-part of U.S. patent application Ser. No. 14/313,991, filed Jun. 24, 2014, now U.S. Pat. No. 9,441,381, issued Sep. 13, 2016. U.S. patent application Ser. No. 15/263,132 and U.S. patent application Ser. No. 14/313,991 are incorporated herein by reference in their entirety.

TECHNICAL FIELD

This disclosure relates generally to construction elements, and relates more particularly to baseboard elements.

BACKGROUND

In a construction environment, it is often desirous for aesthetic and functional purpose to protect an underlying bare surface, such as a wall or floor, from dirt, grime, grease, bacteria, animals, and any other deleterious elements. For example, in a commercial environment such as a; restaurant, cafeteria, food stand, etc., finishing items are generally installed over a bare surface to create a finished or working surface. Generally, such finishing items cover and treat bare surfaces using various wall board, sheet rock, plaster, backsplashes, tile, wallpaper, carpeting, wood, paneling, vinyl, etc.

With the installation of these finishing items, it is typical to install construction trim elements, like baseboards, crown molding, wainscoting, etc., to cover or seal a transition from one finishing item to the other. Such construction trim elements have inherent flaws that allow or promote the above mentioned deleterious elements. For example, almost all of these construction trim elements are installed using nails, staples, glues, caulks and the like that are ineffective to completely seal the finishing items. Moreover, such trim elements may degrade, peel, warp, etc., by using standard securing techniques. What is needed is a construction trim element that can operate to seal and/or operate as a transition from one surface finishing item to another, and prevent any of the aforementioned deleterious materials from contacting the underlying base surfaces.

BRIEF DESCRIPTION OF THE DRAWINGS

A more complete understanding of a construction element may be derived by referring to the detailed description and claims when considered in connection with the following illustrative figures. In the following figures, like reference numbers refer to similar elements and steps throughout the figures.

FIG. 20 illustrates an enlarged left side view of a portion of the baseboard element of FIG. 15 holding the wall cladding of FIG. 18 against the wall of FIG. 18 using the sealant indentation of FIG. 18 in the wallboard of FIG. 18, as identified in FIG. 19;

FIG. 21 illustrates an enlarged left side view of a portion of the baseboard element of FIG. 15 attached to the flooring base of FIG. 18, as identified in FIG. 19;

Figure 1:
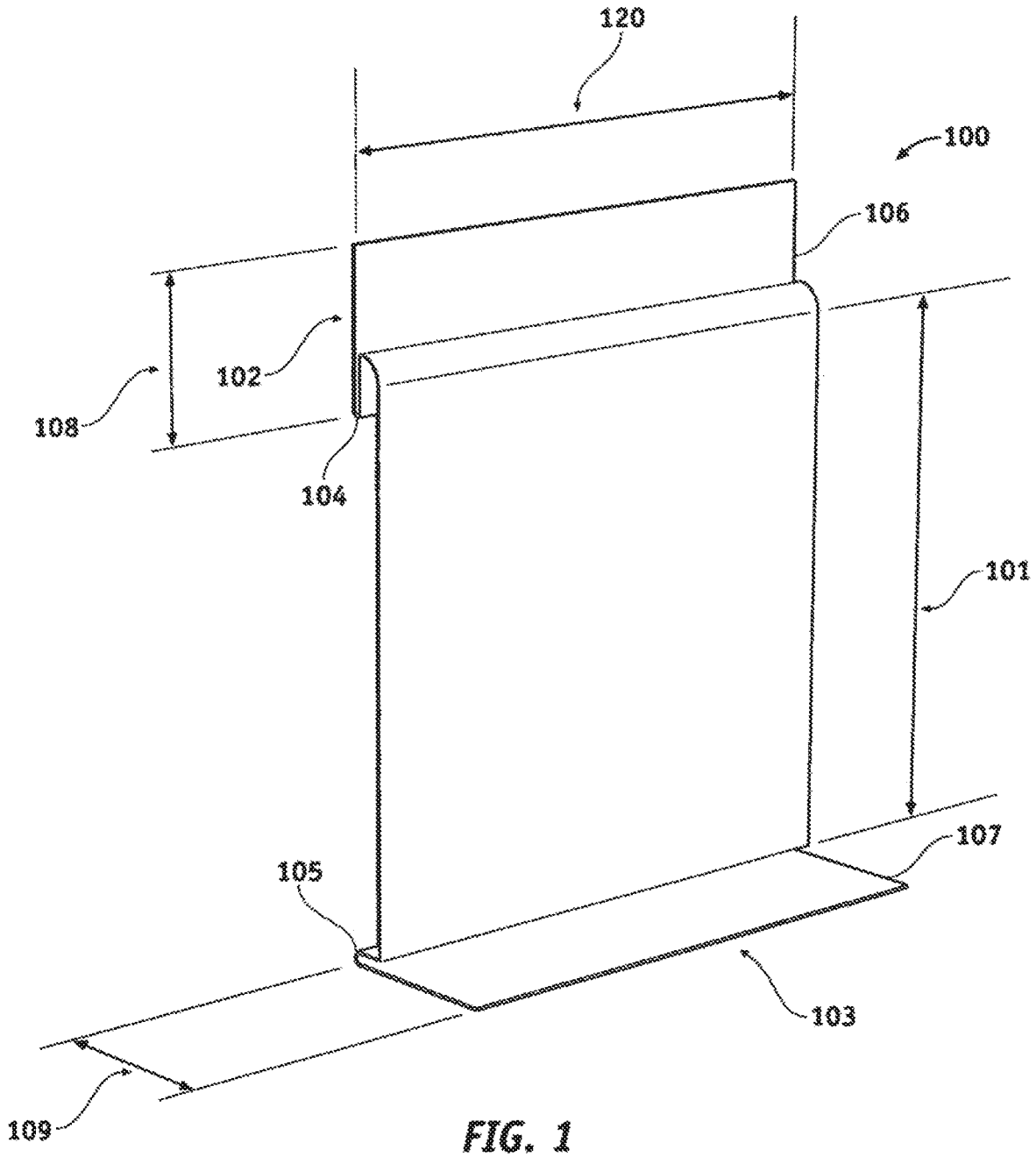
FIG. 1 representatively illustrates an exemplary embodiment of a construction element.

Elements and/or any steps among the figures are illustrated for simplicity and clarity and have not necessarily been rendered according to any particular sequence. For example, steps that may be performed concurrently or in different order may be illustrated in the figures to help to improve understanding of embodiments of the construction element. Moreover, elements may be constructed in various combinations and/or permutations.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant. "Mechanical coupling" and the like should be broadly understood and include mechanical coupling of all types.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value. In some embodiments, "approximately" can mean within plus or minus ten degrees of the stated value. In other embodiments, "approximately" can mean within plus or minus five degrees of the stated value. In yet other embodiments, "approximately" can mean within plus or minus one degree of the stated value.

DESCRIPTION OF EXAMPLES OF EMBODIMENTS

Among various representative embodiments, a construction (trim) element may comprise a span of continuous sheet material, generally stainless steel, having a leading top edge folded back upon itself in a fashion to form an integrated leading top edge groove to accept an edge of a first planar material within the leading top edge groove. The construction element may further comprise a leading bottom edge folded back upon itself in a fashion to form an integrated leading bottom edge groove to accept an edge of a second planar material within the leading bottom edge groove. In an embodiment; the construction element, the first planar material, and the second planar material assemble to comprise a continuous barrier for a bare or base surface, such as a wall, floor, or both.

Among various representative embodiments, the span of continuous sheet material may be dimensioned to operate as at least one of a baseboard construction element, a crown molding construction element, a wainscoting construction element, or any other construction element now known or developed in the future. Representative embodiments may comprise a leading top edge groove and a leading bottom edge groove to be substantially co-planar, substantially normal to one another, or comprise any other variable acute or obtuse angles between them. Some representative embodiments may comprise a construction element to comprise one or more mid-body grooves and/or breaks to support large spans of sheet material from flexing and/or to provide a groove to support other attaching elements.

Among other representative embodiments, a construction element may comprise a span of continuous sheet material having a first edge portion folded back upon itself in an "S" shaped pattern to form an integrated first edge portion groove to accept an edge of a planar material within the first edge portion groove. The construction element may also comprise a leading second edge portion, opposite the first edge portion, folded back upon itself to form a bull nosed configuration.

Among various representative embodiments, methods of the construction element may comprise a method for manufacturing, packaging, marketing, distributing, and/or selling the construction element.

A number of embodiments include a baseboard element. The baseboard element can include a nose portion including a nose bottom section, a nose top section extending approximately parallel to the nose bottom section, and a nose face section extending between the nose bottom section and the nose top section. The baseboard element also can include a riser portion comprising a riser section extending approximately perpendicular to the nose top section, and a riser bend extending between the riser section and the nose top section of the nose portion. The baseboard section additionally can include a wall groove portion comprising a groove front section extending approximately parallel to the riser section of the riser portion, a groove back section extending approximately parallel to the groove front section, a groove bottom bend extending between the groove front section and the groove back section, and a groove top bend extending between the groove front section and the riser section of the riser portion.

Additional embodiments include a method of providing a baseboard element. The method can include forming a nose portion. Forming the nose portion can include folding a nose bottom bend between a nose bottom section and a nose face section. Forming the nose portion also can include folding a nose top bend between the nose face section and a nose top section. The nose top section can extend approximately parallel to the nose bottom section. The nose face section can extend between the nose bottom section at the nose bottom bend and the nose top section at the nose top bend. The method also can include forming a riser portion. Forming the riser portion can include folding a riser bend between the nose top section of the nose portion and a riser section. The riser section can extend approximately perpendicular to the nose top section. The method additionally can include forming a wall groove portion. Forming the wall groove portion can include folding a groove top bend between the riser section of the riser portion and a groove front section. The groove front section can extent approximately parallel to the riser section of the riser portion. Forming the wall groove portion also can include folding a groove bottom bend between the groove front section and a groove back section. The groove back section can extend approximately parallel to the groove front section.

Some embodiments can include a baseboard element comprising a nose portion, a riser portion, and a wall groove portion coupled to the riser portion. The nose portion can include a nose bottom section and a nose face section. The riser portion can include a riser section extending approximately perpendicular to the nose bottom section and a riser bend coupled to the nose portion. The riser section can be substantially planar and can define a plane. The nose portion can be positioned only on a first side of the plane defined by the riser section, and the wall groove portion can be positioned only on a second side of the plane, the second side opposite the first side. The nose bottom section can comprise a nose bottom edge at a terminal end of the nose bottom section, without any structure of the baseboard element extending beyond the terminal end from the terminal end. The nose bottom edge of the nose bottom section can be either approximately at the plane or closer to the plane than the nose face section is to the plane.

A number of embodiments can include a method of providing a baseboard element. The method can include: (a) forming a nose portion; (b) forming a riser portion; and (c) forming a wall groove portion. Forming the nose portion can include folding a nose bottom bend between a nose bottom section and a nose face section. Forming a riser portion can include folding a riser bend between the nose portion and a riser section. The riser section can extend approximately perpendicular to the nose bottom section. The riser section further can be substantially planar. Additionally, the riser section can define a plane. The nose portion can be located only on a first side of the plane defined by the riser section, and the wall groove portion can be located only on a second side of the plane defined by the riser section, the second side opposite the first side of the plane defined by the riser section. Forming the wall groove portion can include folding a groove top bend between the riser section of the riser portion and a groove front section. Furthermore, the nose bottom section can comprise a nose bottom edge at a terminal end of the nose bottom section, without any structure of the baseboard element extending beyond the terminal end from the terminal end. The nose bottom edge of the nose bottom section can be either approximately at the plane or closer to the plane than the nose face section is to the plane.

A construction element may be described herein by terms of various functional elements and various method steps. Such functional elements may be realized by any number of hardware components adapted to perform generalized or specific functions to achieve various results. For example, the construction element may employ various construction element components, e.g., various materials, such as stainless steel, standard steel grades, aluminum, copper, various alloy combinations, vinyl, and any other natural and/or synthetic materials whether now known or developed in the future. Moreover, the construction element may comprise various structural configurations, for example, tongue and grooves, slots, laps, welds, snaps, latches, wells, and the like, which may carry out a variety of functions. And each structural configuration may comprise any number or permutations of configurations; for example, various scale, gauge, finish, size, geometry, surface texture, and the like may be employed.

Those skilled in the art will understand that the construction element may be practiced as part of any variety of construction element and/or finishing applications, whether for commercial, industrial, and/or residential, purpose; and any particular system, method, and/or purpose described is merely exemplary for the construction element. Those skilled in the art will further understand that the construction element may be practiced by any number of other applications and environments, whether now known or developed in the future. Finally, those skilled in the art will understand that the construction element may employ any number of conventional techniques for manufacturing, installing, packaging, marketing, distributing, and/or selling the construction element.

Various representative implementations of the construction element may be applied to any construction system. Referring now to FIG. 1, an exemplary embodiment of a construction element 100 may comprise a span 101 of continuous sheet material comprising a leading top edge 102 folded back upon itself in a fashion to form an integrated leading top edge groove 104. Construction element 100 may further comprise a leading bottom edge 103 folded back upon itself in a fashion to form an integrated leading bottom edge groove 105. Among various exemplary embodiments, spans, such as span 101, may comprise any dimensional length depending on the purpose for which the construction element may be used. For example, if construction element 100 were configured for use as a baseboard trim or crown molding application, span 101 may comprise a rather limited span dimension of a few inches. Whereas, if construction element 100 were configured for use as a wainscoting, backsplash or other larger application, then span 101 may comprise a span dimension of several inches, and possibly several feet.

Among various exemplary embodiments, those skilled in the art will understand that construction elements disclosed herein may comprise various materials, preferably stainless steel, but other materials such as, standard steel grades, aluminum, copper, various alloy combinations, vinyl, and any other natural and/or synthetic materials whether now known or developed in the future, may likewise be used.

Figure 2:
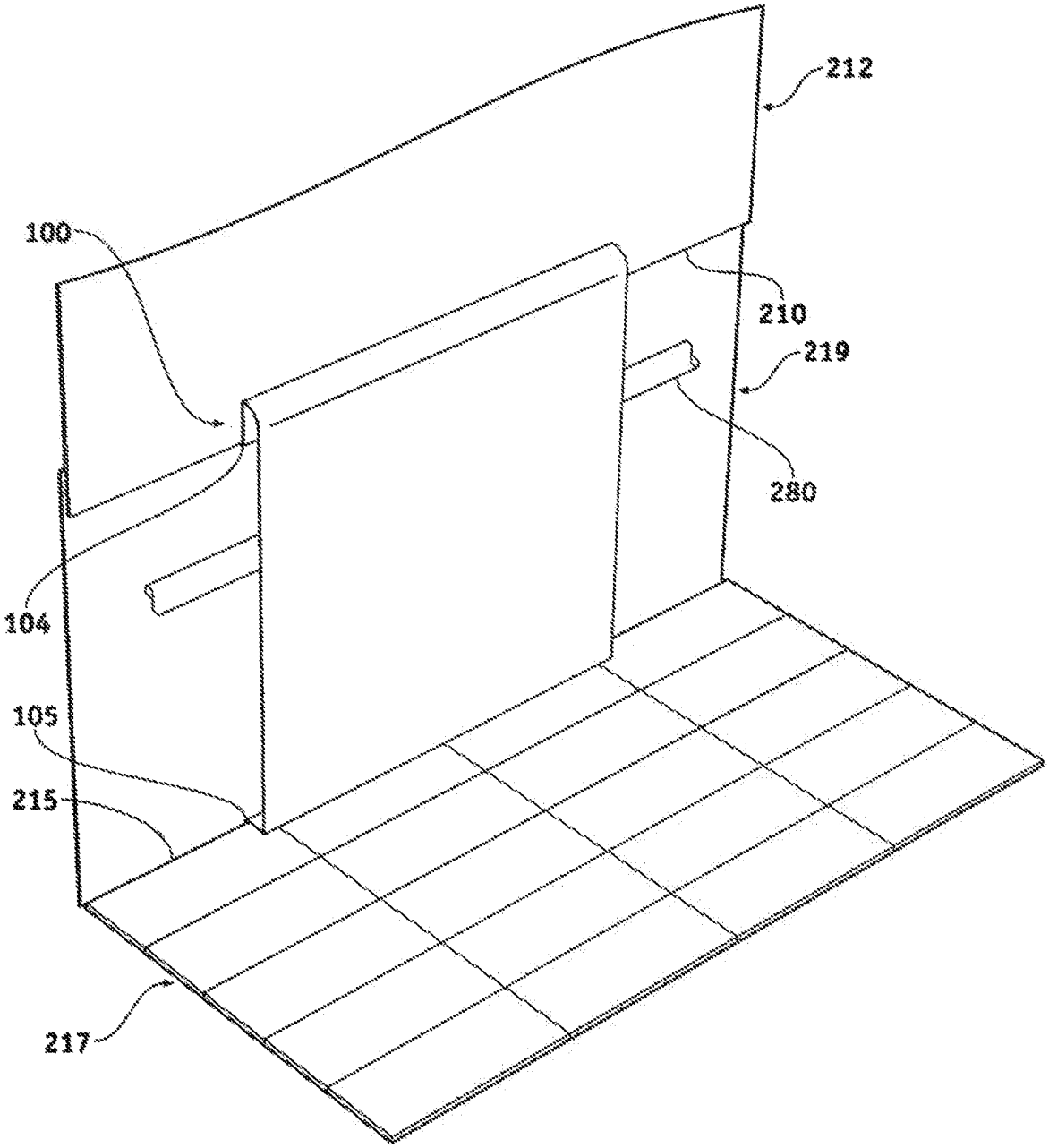
FIG. 2 representatively illustrates the exemplary embodiment of the construction element as used in a particular environment.

Turning now to FIG. 2, among various exemplary embodiments, construction element 100, comprising leading top edge groove 104, may be adapted to accept an edge 210 of a first planar material 212 within leading top edge groove 104. Similarly, leading bottom edge groove 105 may be adapted to accept an edge 215 of a second planar material 217 within leading bottom edge groove 105. In an embodiment; construction element 100, first planar material 212, and second planar material 217 may assemble to comprise a continuous barrier for a surface, such as a surface 219, which may comprise a wall, a floor, a corner, a post, etc. Among various exemplary embodiments, any first planar materials and/or any second planar materials may be secured within their respective grooves by any now known or future developed technology. For example, first planar material 212 and/or second planar material 217 may be secured within respective grooves 104 and 105 preferably by friction fits, but glues, welds, caulks, rivets, screws, bolts, and any other securing mechanisms now known or developed in the future may be used. Moreover, construction element 100 may be secured to the base surface, such as surface 219, using various securing mechanisms, such as caulks, glues, foams, rivets, nails, clamps, epoxies, and the like, or the construction element may be free floating.

Those skilled in the art will understand that among various exemplary embodiments, construction elements may comprise grooves having dimensions to accommodate planar materials, such as first planar material 212 and second planar material 217, so that the planar materials fit securely within the grooves. For example, if first planar material 212 comprised a dimensional thickness of a few millimeters, then groove 104 would comprise a similar width such that first planar material 212 would fit tightly within groove 104.

Figure 3:
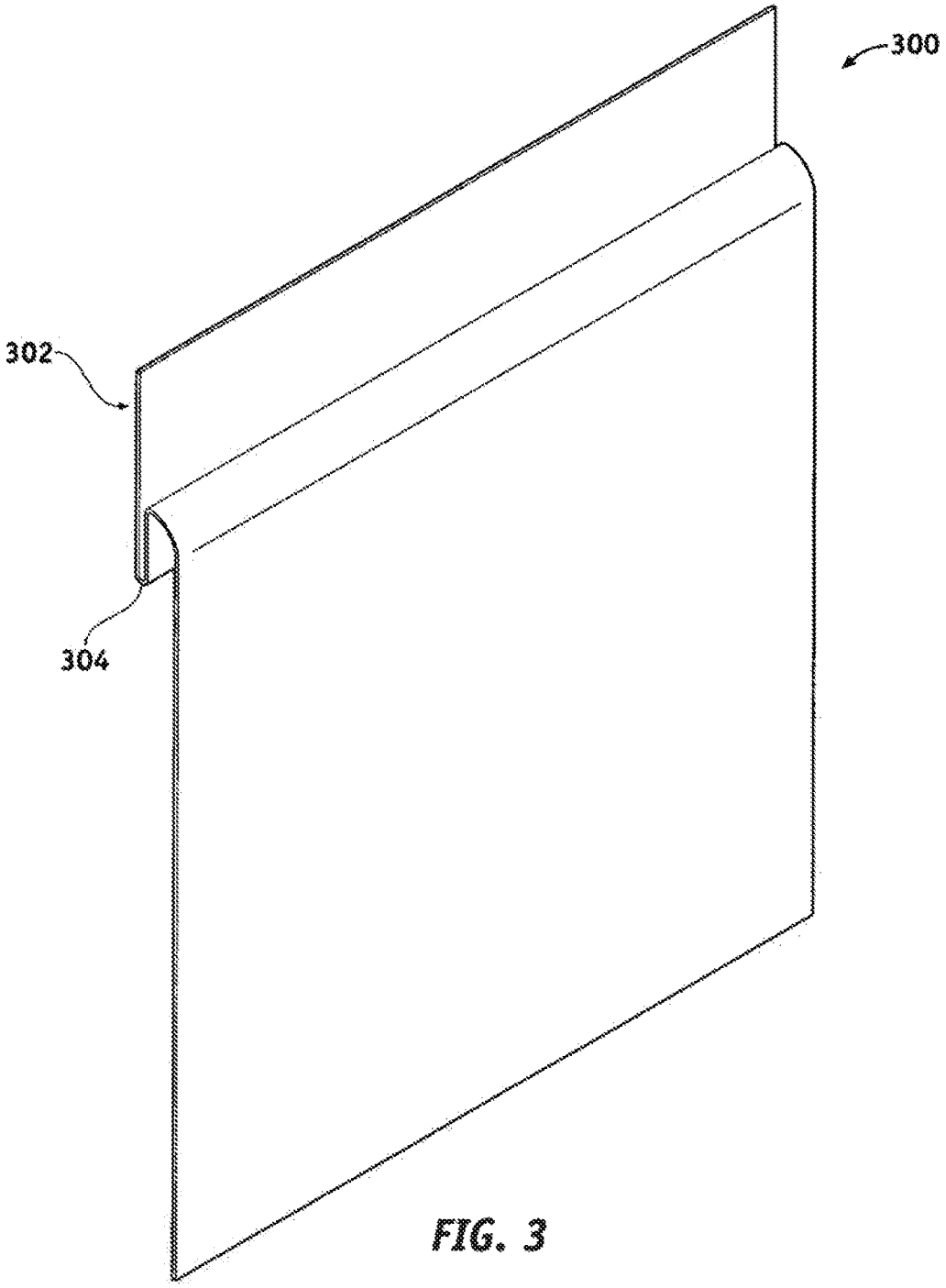
FIG. 3 representatively illustrates another exemplary embodiment of a construction element.

Returning to FIG. 1, construction element 100 may comprise a top flashing 106 comprising a top flashing span 108. Similarly, construction element 100 may comprise a bottom flashing 107 comprising a bottom flashing span 109. Those skilled in the art will understand that spans 108 and 109 may comprise any dimension to adapt to any particular application so as to engage construction element 100 to planar elements 212 and 217, thereby providing a secure barrier to base surface 219. It will be further understood by those skilled in the art that some exemplary embodiments of construction element 100 may comprise a configuration that comprises only one of a leading top edge groove or one of a leading bottom edge groove. For example, FIG. 3 representatively illustrates a construction element 300 that may comprise a leading top edge groove 304 of a leading top edge 302, but in this exemplary embodiment, construction element 300 does not comprise a leading bottom edge groove. Alternately, a construction element may comprise a configuration, though not shown, having only a leading bottom edge groove of a leading bottom edge, but without a leading top edge groove. Furthermore, the flashings, such as top flashing 106 and bottom flashing 107, are shown as substantially planar, but those skilled in the art will understand that such flashings may be bent as a whole or at any point or points along the flashing to accommodate uneven surfaces, provide support/rigidity or even comprise various other non-planar shapes.

Returning again to FIG. 1, construction element 100 is representatively illustrated comprising a width 120, however, it will be understood by those skilled in the art that construction element 100 may be dimensioned to comprise any width to adapt to any particular application. For example, in an embodiment, construction element 100 may comprise of a single width to adapt to a particular span, or, in another embodiment, a plurality of construction elements may be positioned sequentially to cover the span. And among the embodiment that uses sequentially positioned construction elements, the construction elements may be overlapped or butted against one another and joined using a variety of joining technologies, such as, welds, caulks, glues, rivets, etc. In addition, transition construction elements (not shown) may be placed behind the seams of butted construction elements to further act as a barrier.

Figure 4:
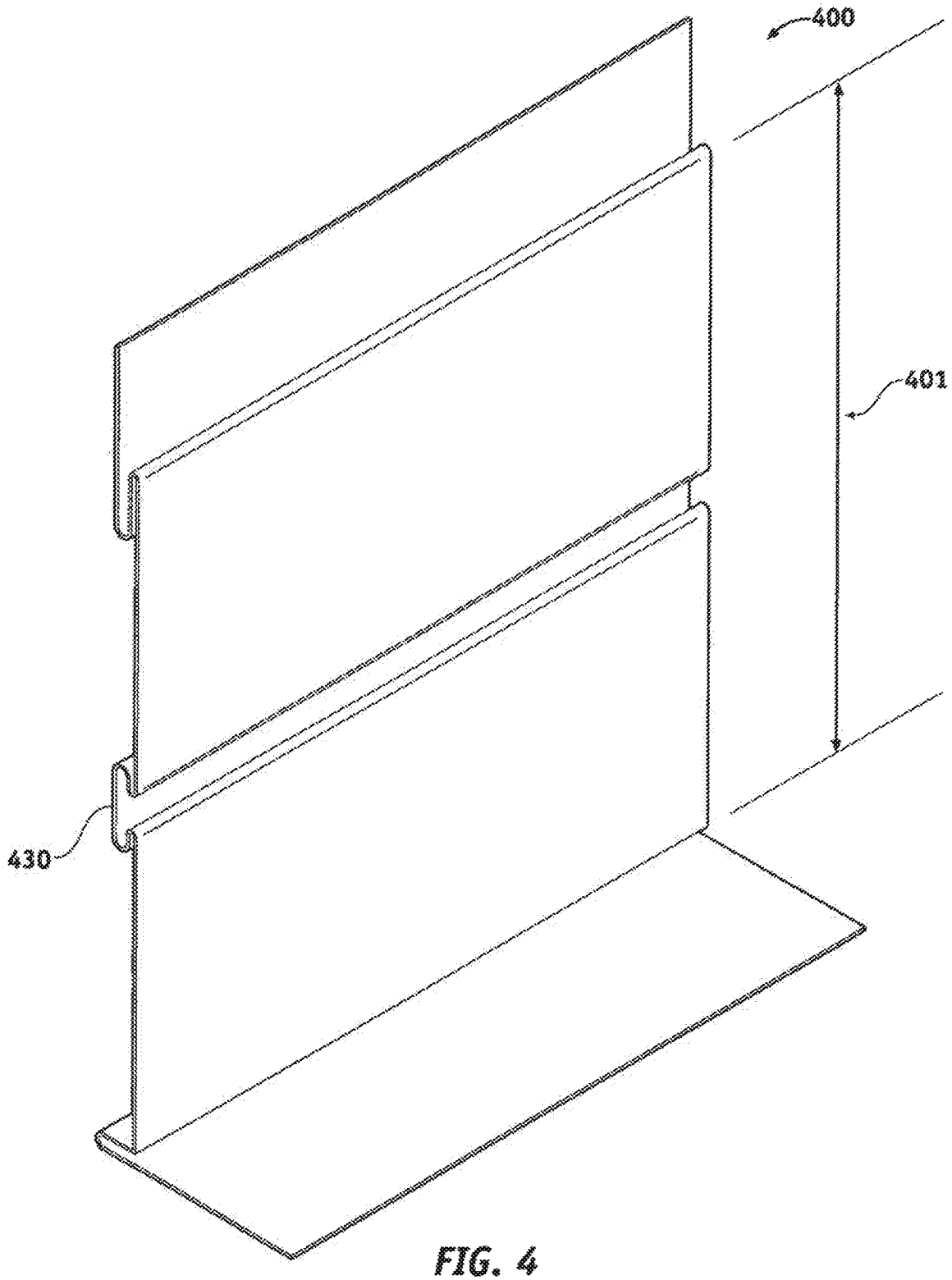
FIG. 4 representatively illustrates yet another exemplary embodiment of a construction element.

Turning now to FIG. 4, an exemplary embodiment of a construction element, construction element 400, may comprise a mid-body groove 430, which on larger spans may aid to support span 401 from flexing, bending, denting, etc. Moreover, mid-body groove 430 may additionally operate to support items (not shown) within mid-body groove 430, such as hooks, utensils, shelving, brackets, papers, or any item that can engage a groove. Construction element 400 is representatively illustrated depicting a single groove 430, but other exemplary embodiments may comprise any number of grooves so as to adapt to a particular application.

Figure 5:
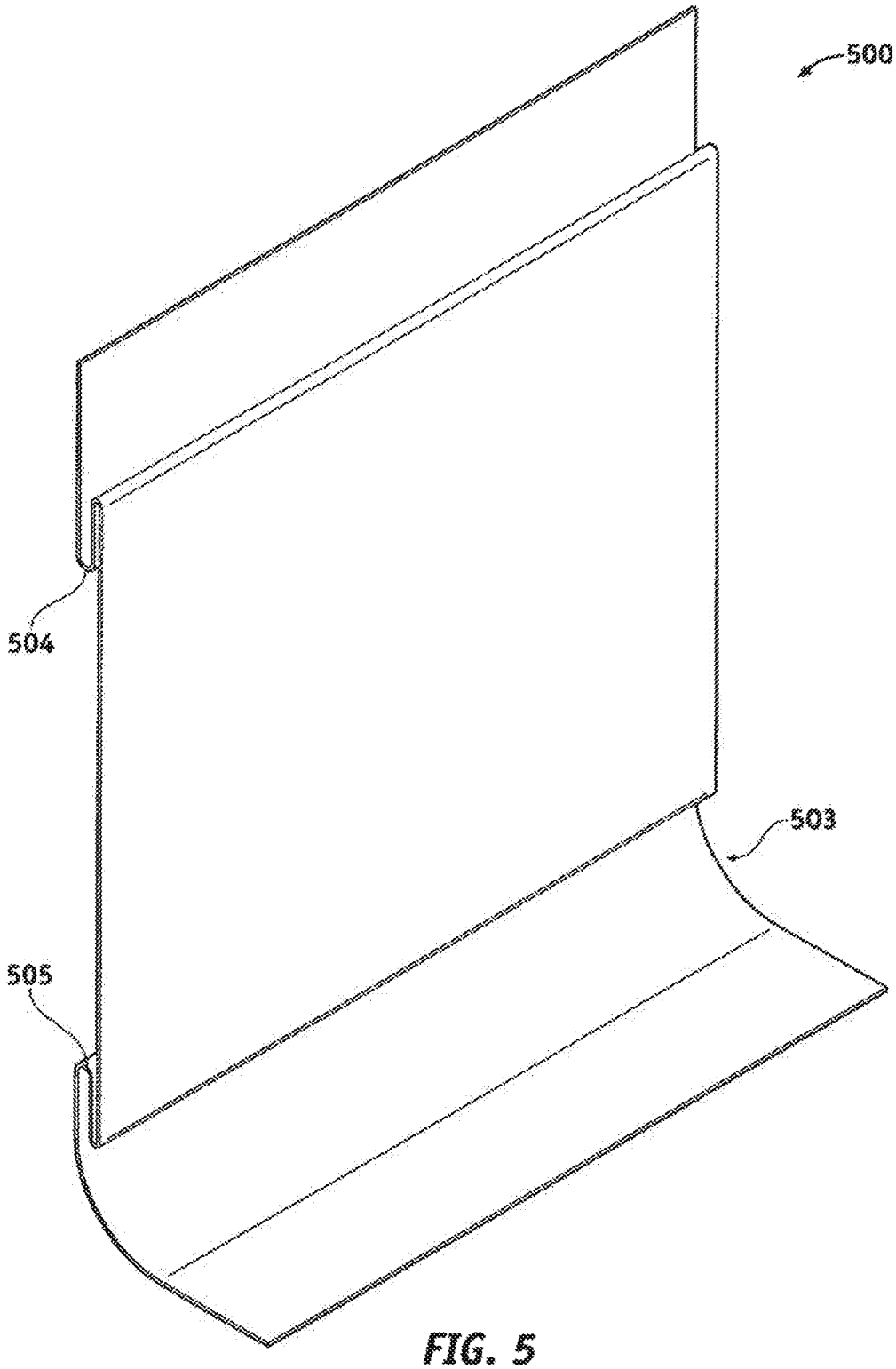
FIG. 5 representatively illustrates still yet another exemplary embodiment of a construction element.

In accordance with an exemplary embodiment of a construction element and with reference to FIG. 5, an alternate construction element 500 comprises a leading bottom edge 503 having an arcuate configuration to, for example, accommodate a flexible planar material, such as, vinyl flooring. Construction element 500 is representatively illustrated showing only leading bottom edge 503 that is arcuate, but other exemplary embodiments may comprise the construction element to comprise both top and bottom leading edges to be arcuate, or construction element 500 may be oriented so that the arcuate leading edge comprises the top portion of construction element 500. It will be further understood by those skilled in the art that either one or both of construction elements' leading edge may comprise other geometric configurations other than planar or arcuate, for example, each leading edge may comprise any regular or irregular configuration so as to accommodate any particular application.

Among various exemplary embodiments of a construction element, a span, such as spans 101 and 401, are depicted as comprising a substantially smooth, planar configuration, but those skilled in the art will understand that the spans may comprise any regular or irregular configuration to accommodate a particular application. For example, instead of being planar, the spans may comprise bends, breaks, a parabolic shape, a domed shape, a concave configuration, etc. Furthermore, the spans may comprise various finishes, such as, a preferable polished finish, but also a textured surface, a patterned surface, an etched surface, etc. Moreover, the spans may be bent, with respect to either one or both of the leading top edges and leading bottom edges to account for any underlying surface anomalies, such as out of plumb, or to accommodate any obstructions, other construction elements, or design requirements.

Among various exemplary embodiments of a construction element, edge grooves, such as edge grooves 104 and 105, are shown in a normal (perpendicular) position, relative to one another. But, as shown in FIG. 5 by grooves 504 and 505, the grooves may be parallel to one another or co-planar. Exemplary embodiments are not limited in this regard, though, and other exemplary embodiments may comprise edge grooves to comprise any acute or obtuse angle between them.

In a preferred embodiment of a construction element, the construction element comprises a stainless steel material configuration. While any material may be used for the construction element and any such material falls within the ambit of this disclosure, stainless steel imparts preferable qualities, such as corrosion resistance, strength, ease of cleaning, etc.

Figure 6:
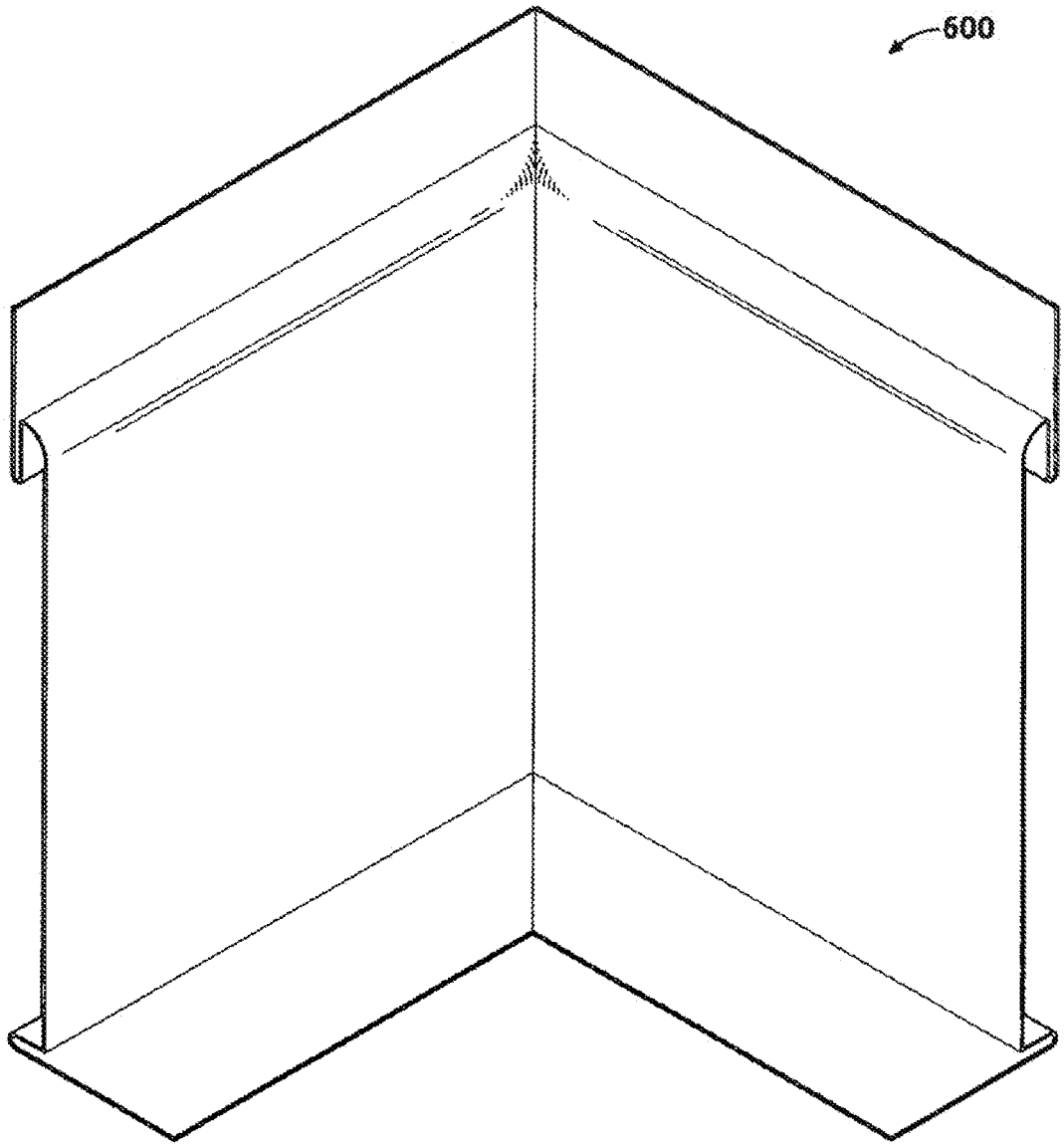
FIG. 6 representatively illustrates an inside corner configuration of an exemplary embodiment of the construction element.
Figure 7:
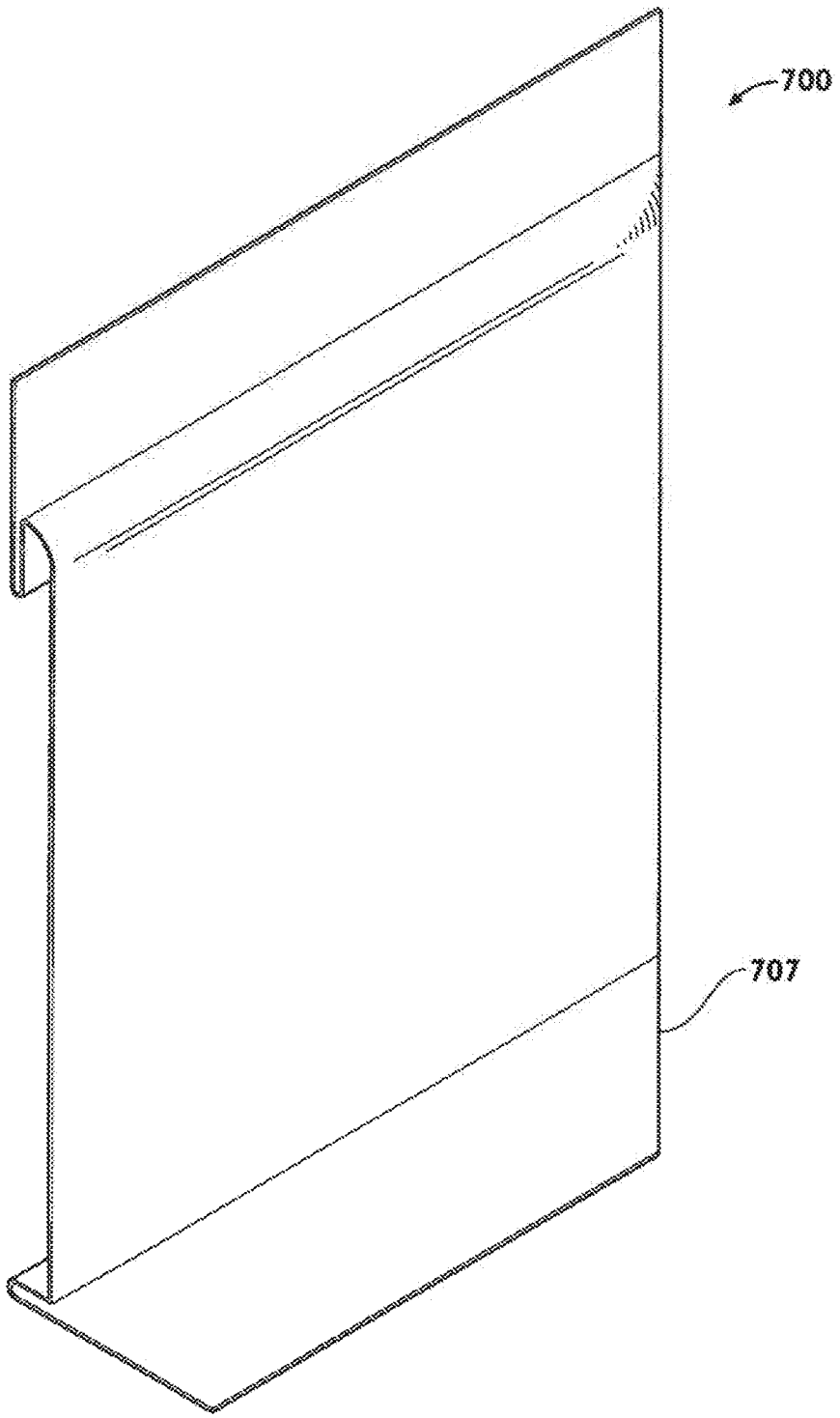
FIG. 7 representatively illustrates an exemplary embodiment of the construction element depicting an angled flashing.

In accordance with various exemplary embodiments, construction elements, such as construction elements 100, 300, 400, and/or 500, may comprise a configuration that accommodates various construction specifications. For example, FIG. 6 representatively illustrates construction element 600, which is configured to accommodate an inside corner. In such an embodiment, two construction elements may be butted up against one another and the flashings, similar to flashing 107 of FIG. 1, may be configured at an angle to allow the two construction elements to align tightly. An example of a construction element comprising an angled flashing is representatively illustrated in FIG. 7. In this exemplary embodiment, construction element 700 comprises angled flashing 707.

Figure 8:
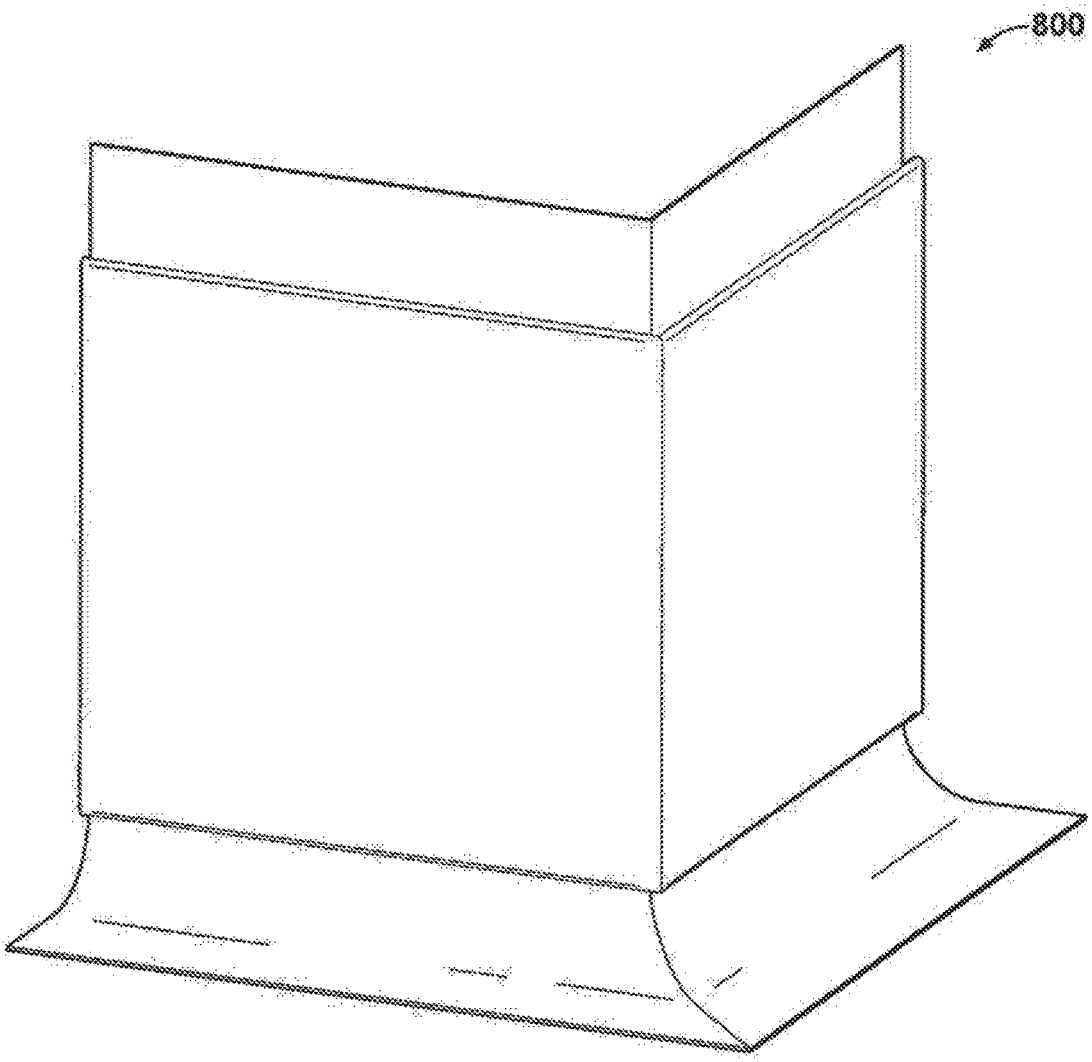
FIG. 8 representatively illustrates an outside corner configuration of an exemplary embodiment of the construction.

In somewhat similar fashion, FIG. 8 representatively illustrates construction element 800 configured to accommodate an outside corner. In such an embodiment, two construction elements may again be butted up against one another and the flashings, similar to flashing 107 of FIG. 1, may be configured at an angle to allow the two construction elements to align tightly. Those skilled in the art will further understand that instead of using two construction elements butted up against one another to create an inside or outside construction element, a single piece may be manufactured for such specific applications. Moreover, it will be understood by those skilled in the art that the construction element is not limited in this inside-corner, outside-corner regard, and that construction elements may be configured to accommodate any variety of acute or obtuse angles so that they may be appropriately used for such angled surfaces. It will also be understood that the construction element may be configured to accommodate various irregular or regular geometric shapes such as hexagons, octagons, etc., as well as rounded, oval shapes or any other curved surface.

Figure 9:
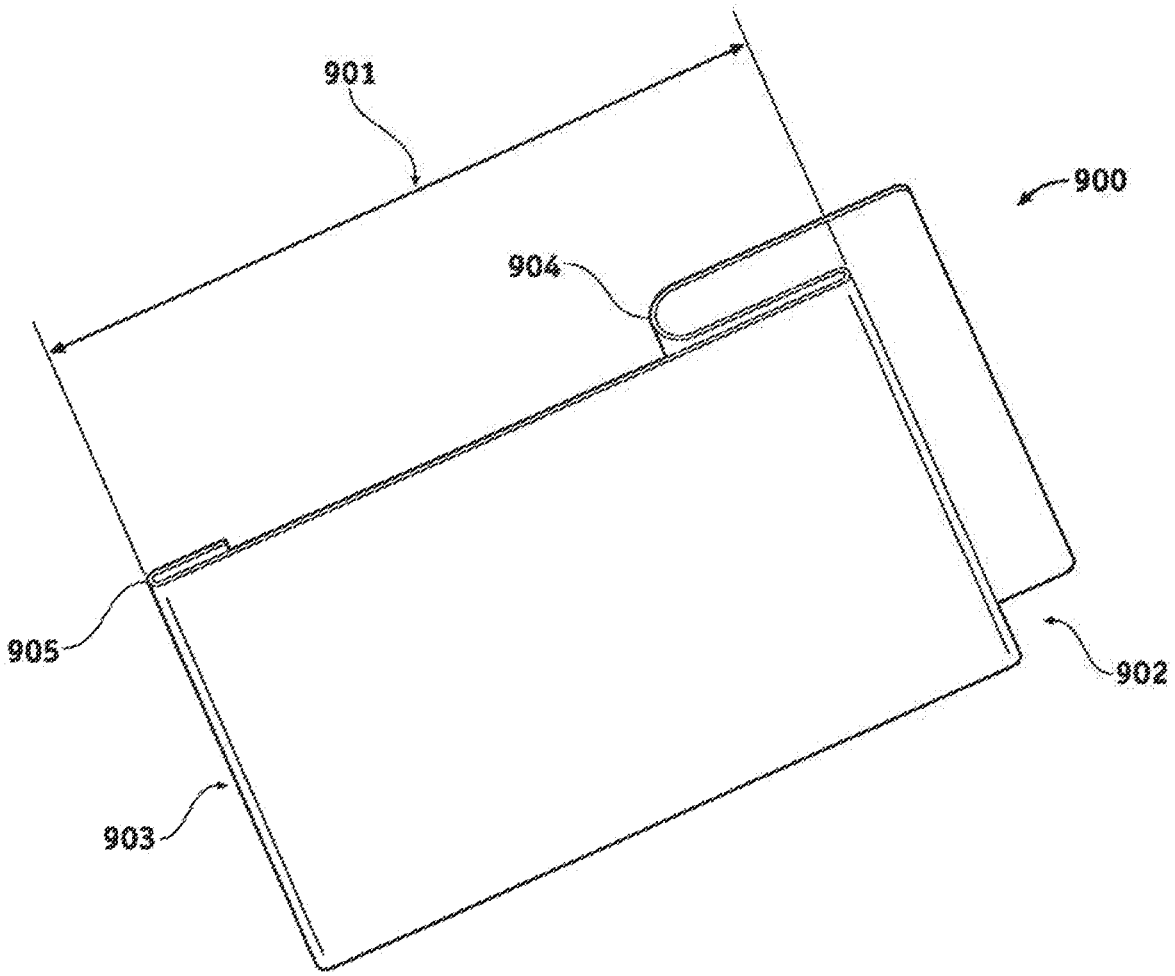
FIG. 9 representatively illustrates another exemplary embodiment of the construction element.
Figure 10:
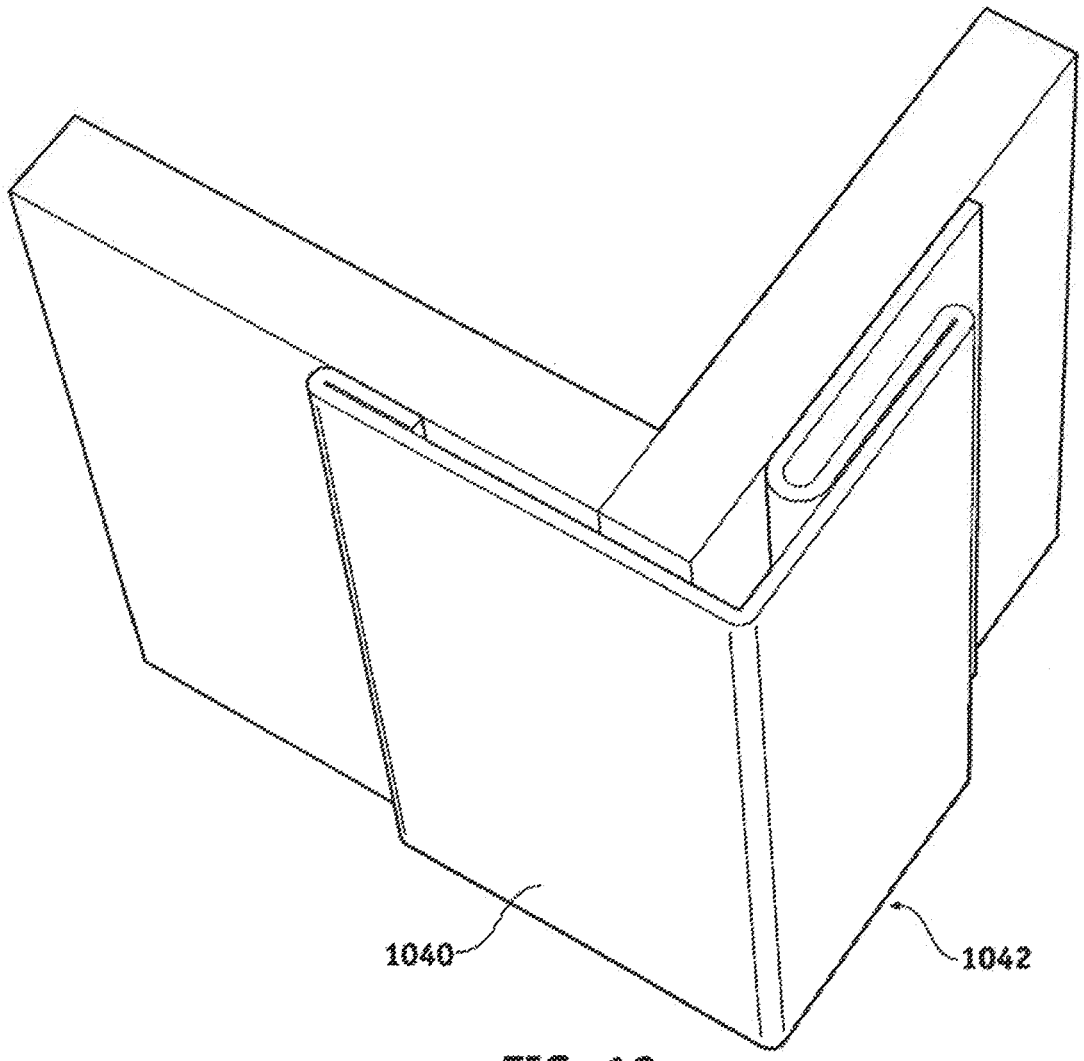
FIG. 10 representatively illustrates the exemplary embodiment as used in an outside corner configuration.
Figure 11:
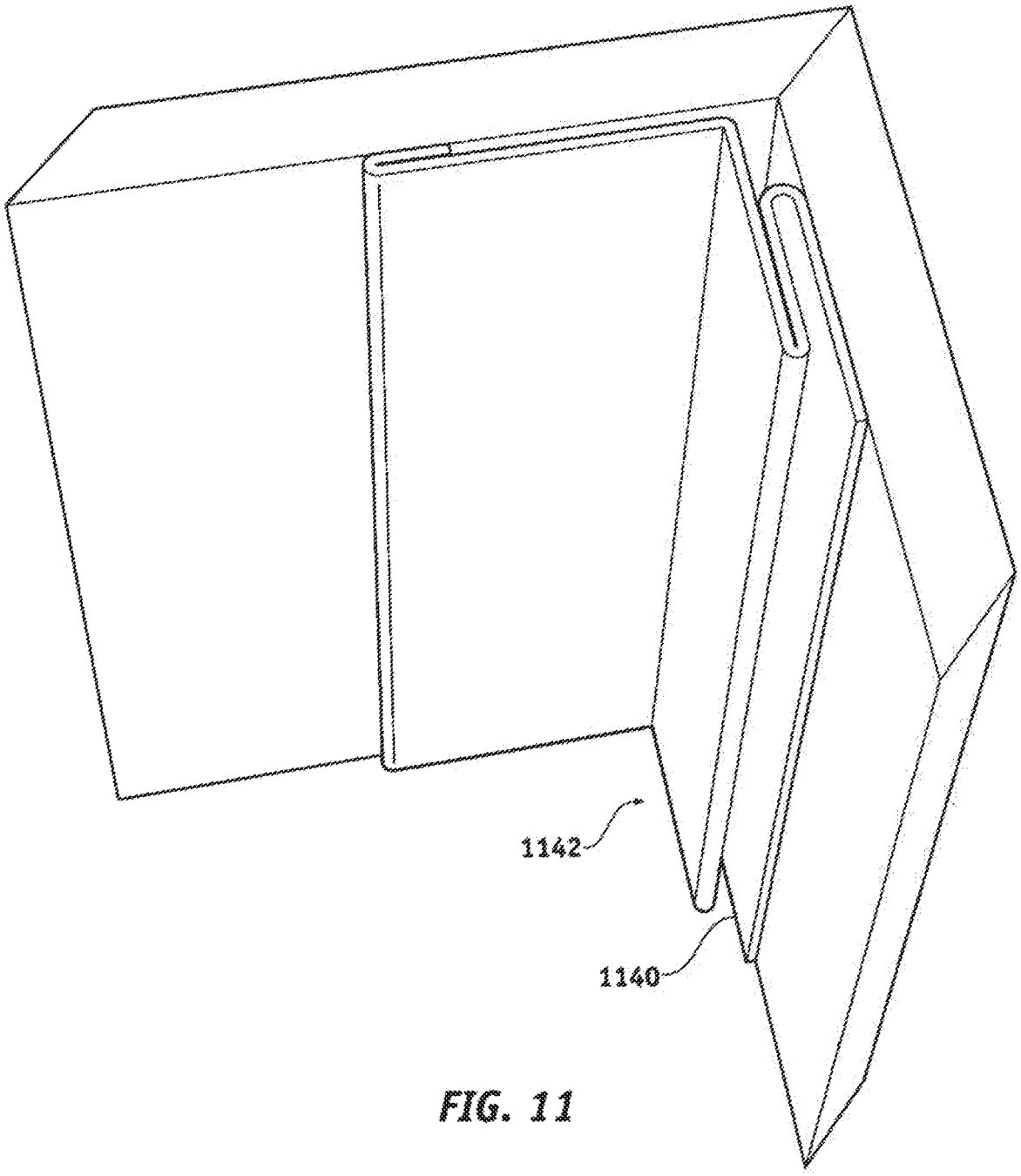
FIG. 11 representatively illustrates the exemplary embodiment as used in an inside corner configuration.
Figure 12:
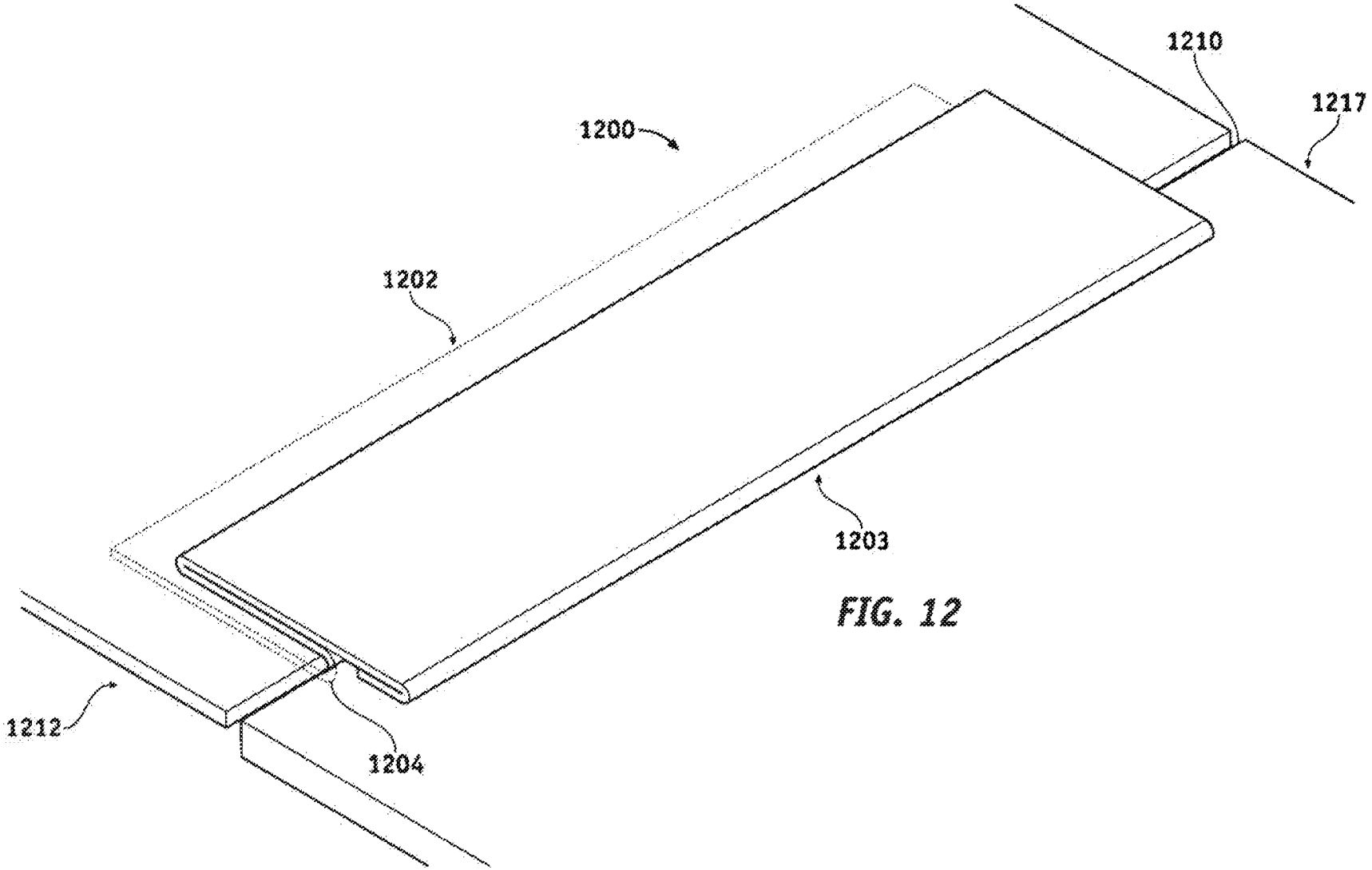
FIG. 12 representatively illustrates the exemplary embodiment as used in a transition configuration.

In accordance with various exemplary embodiments, a construction element may be configured to operate as a finishing trim element. For example, and with reference to FIG. 9, finishing element 900 may comprise a span 901 of continuous sheet material having a first edge portion 902 folded back upon itself in an "S" shaped pattern to form an integrated first edge portion groove 904 to accept an edge of a planar material (not shown) within first edge portion groove 904. Finishing trim element 900 may further comprise a leading second edge portion 903, opposite first edge portion 902, folded back upon it to form a bull nosed configuration 905. Finishing trim element 902 is very similar to construction element 300, FIG. 3, but in this exemplary embodiment, leading second edge portion 903 comprises a bull nosed configuration. It will be understood by those skilled in the art that the basic configuration of finishing trim element 900 may be manipulated, i.e. bent, in a variety of fashions so as to operate as a finishing trim element in a variety of applications. For example, and with reference to FIG. 10, a finishing trim element, similar to trim element 900, may be bent along a mid-line 1040 so as to create a finishing trim element 1042 that may accommodate an outside corner. Similarly, and with reference to FIG. 11, a trim element, similar to trim element 900, may be bent along a mid-line 1140 so as to create a finishing trim element 1142 that may accommodate an inside corner. In still yet another embodiment, a finishing trim element may not be bent in any fashion, and may be used as a transition from one finishing surface to another, as representatively illustrated by FIG. 12. In this embodiment, trim element 1200 comprises a first edge portion 1202 comprising a first edge portion groove 1204, which can receive an edge 1210 of a first planar material 1212; a second edge portion 1203 is positioned over a second planar material 1217 to complete the transition.

Figure 13:
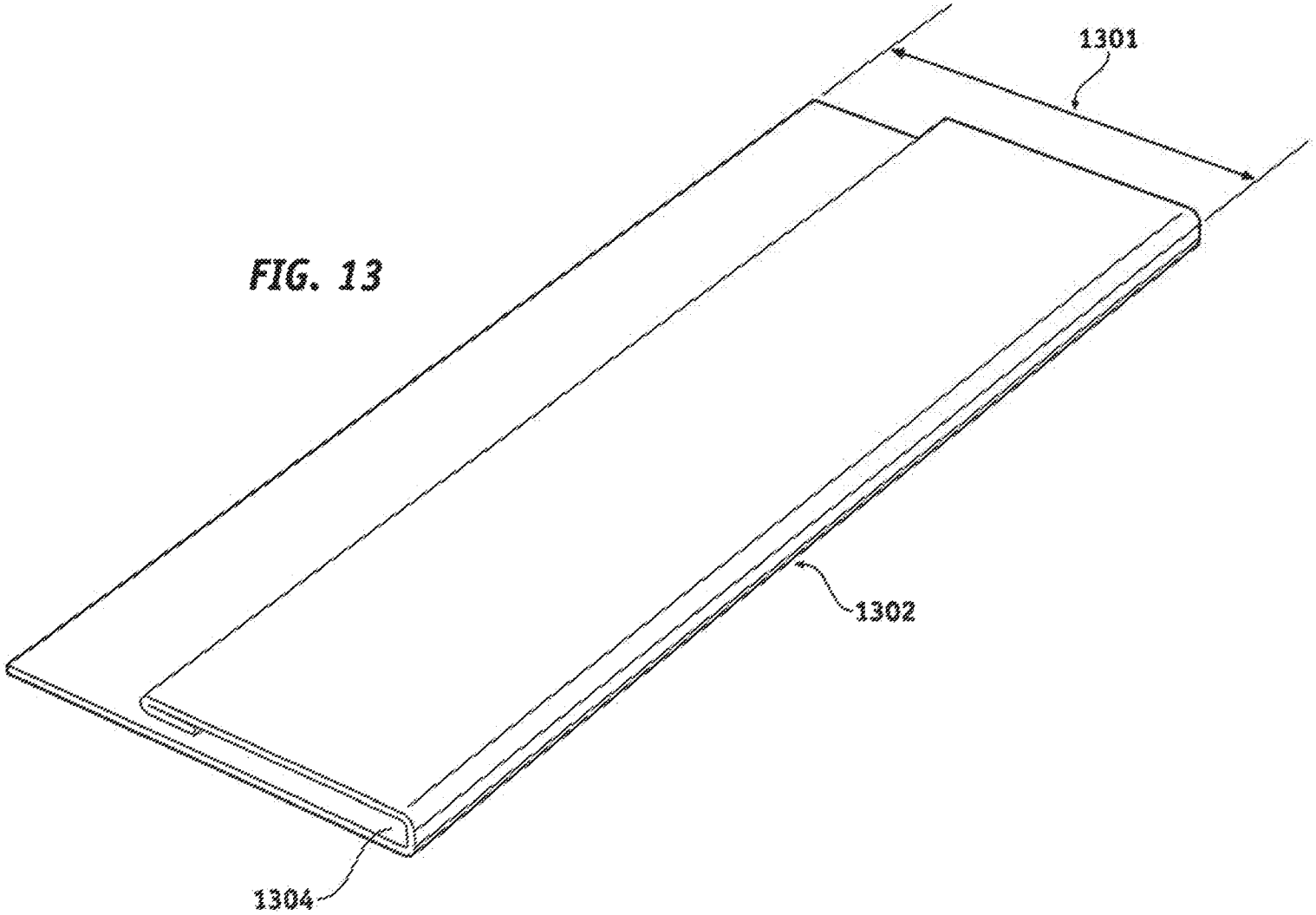
FIG. 13 representatively illustrates another exemplary embodiment of a construction element.
Figure 14:
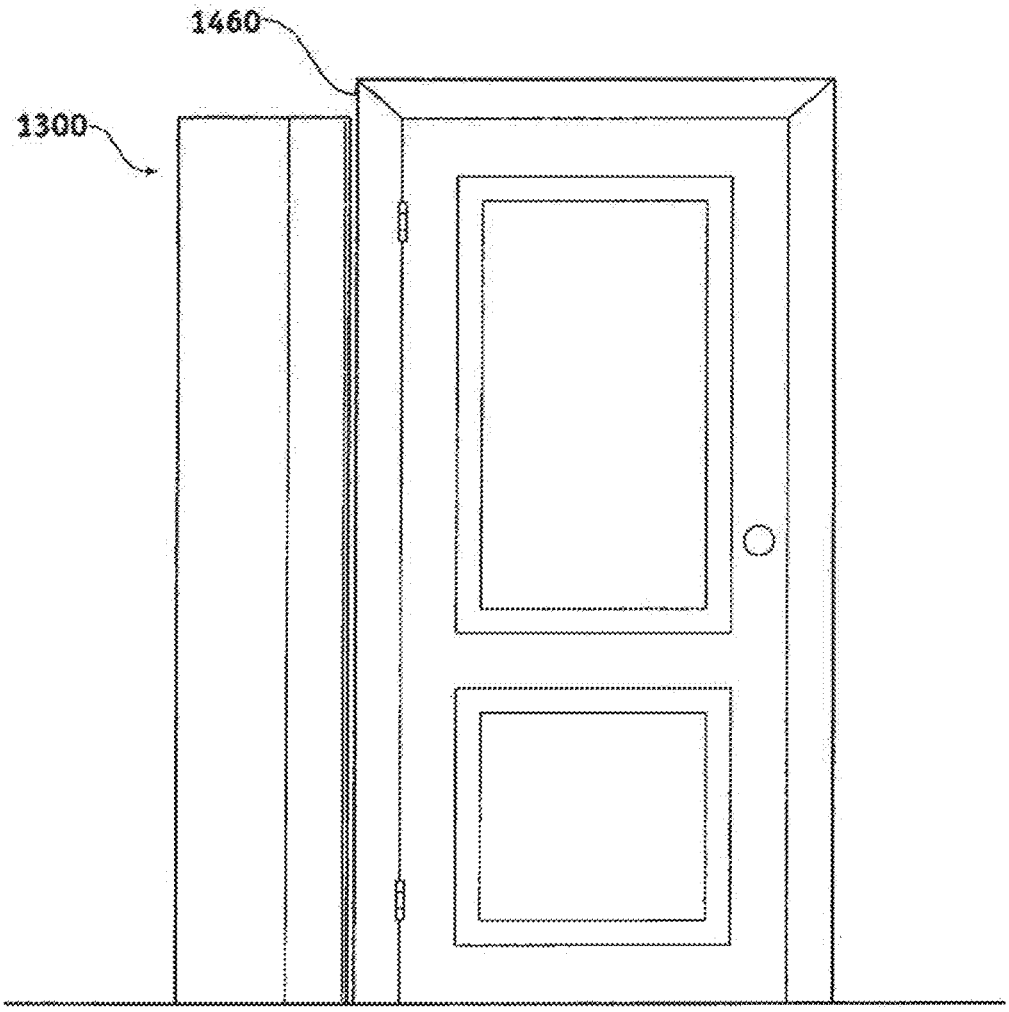
FIG. 14 representatively illustrates the exemplary embodiment of the construction element as used in a particular environment.

In accordance with still another exemplary embodiment, and with reference to FIGS. 13 and 14, in the most simplest form a construction element 1300 may comprise a span 1301 and a first leading edge 1302 comprising, in a "U" shaped fashion, first leading edge groove 1304. This configuration is suitable as a termination type finishing element and best demonstrated by FIG. 14. In this example, construction element 1300 may be installed adjacent other finishing trim, such as doorway trim 1460.

Among the various exemplary embodiments disclosed, it is evident that the configuration of the construction element lends itself to comprise various advantages over currently used construction elements. For example, other construction elements are generally mounted flush to an underlying surface. The herein disclosed construction elements, though, comprise a configuration when installed that may result in a gap between the construction element's span and the underlying surface. This may beneficially allow for ambient air to flow freely behind the construction element, thereby deterring any stagnant environment that might promote the growth of bacteria, mold, odors, etc. Moreover, and as can be seen best by FIG. 2, other construction elements, such as a conduit, like conduit 280, may be positioned behind the construction element, thereby concealing it without any bulges, bends, creases, and the like to the construction element's span surface.

Among the various exemplary embodiments disclosed herein, those skilled in the art will understand that the specific configurations of construction elements discussed, such as spans, leading edges, leading edge grooves, etc., are not limited in such specific regard. For example, a construction element may comprise any number and/or combination or permutation of configurations discussed, such as grooves, bull nosed folds, S-Shaped folds, U-shaped folds, bends, breaks, hems, and the like, or none at all.

In accordance with an exemplary method of a construction element, a user may assemble a barrier for a surface by providing a construction element comprising a span of continuous sheet material, preferably stainless steel, comprising a leading top edge folded back upon itself in a fashion to form an integrated leading top edge groove to accept an edge of a first planar material within the leading top edge groove. In accordance with this exemplary method, the construction element may further comprise a leading bottom edge folded back upon itself in a fashion to form an integrated leading bottom edge groove to accept an edge of a second planar material within the leading bottom edge groove. The user may then assemble; the construction element, the first planar material, and the second planar material to comprise a continuous barrier for the surface, for example, at least one of a wall and a floor.

Among various exemplary embodiments, a span of continuous sheet material may be dimensioned to operate as at least one of a baseboard trim construction element, a crown molding construction element, and a wainscoting construction element. Moreover, a leading top edge groove and a leading bottom edge groove may be comprised to form grooves that are; substantially co-planar to one another, substantially normal to one another, and any other obtuse or acute angle. Additionally, a construction element may comprise a formed mid-body groove to support the span of the sheet material from flexing, and a construction element may be folded at a leading top, bottom or any other perimeter edge, to comprise an "S" shape, a "U" shape, a bull-nosed shape configuration, or not folded at all.

Figure 16:
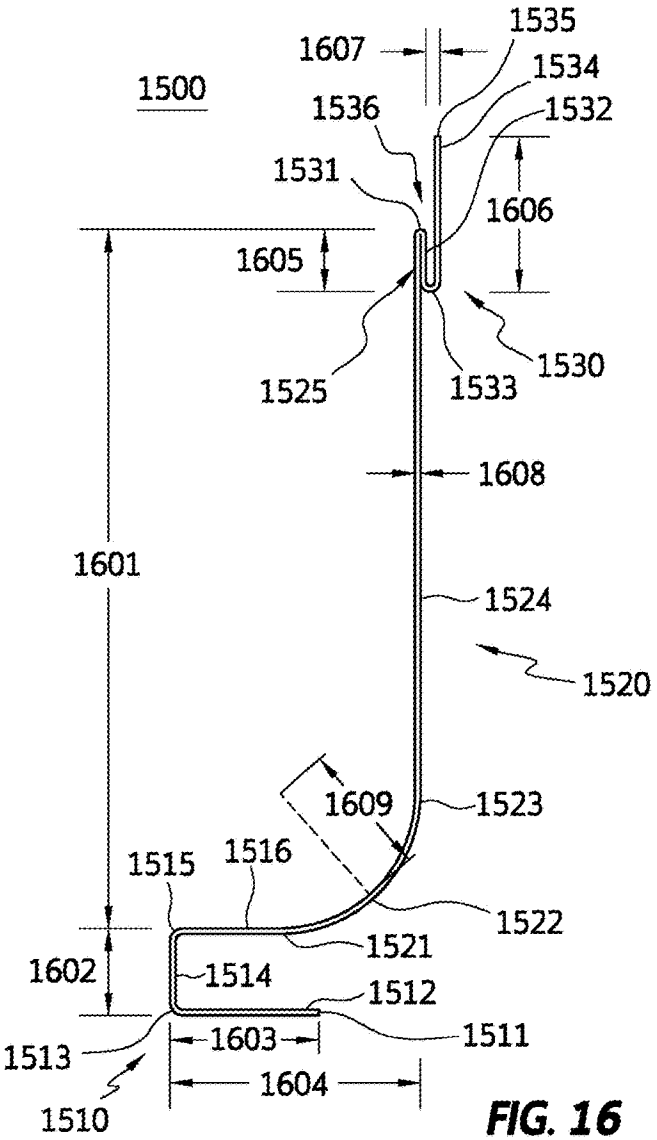
FIG. 16 illustrates a right side view bottom of the baseboard element of FIG. 15.
Figure 15:
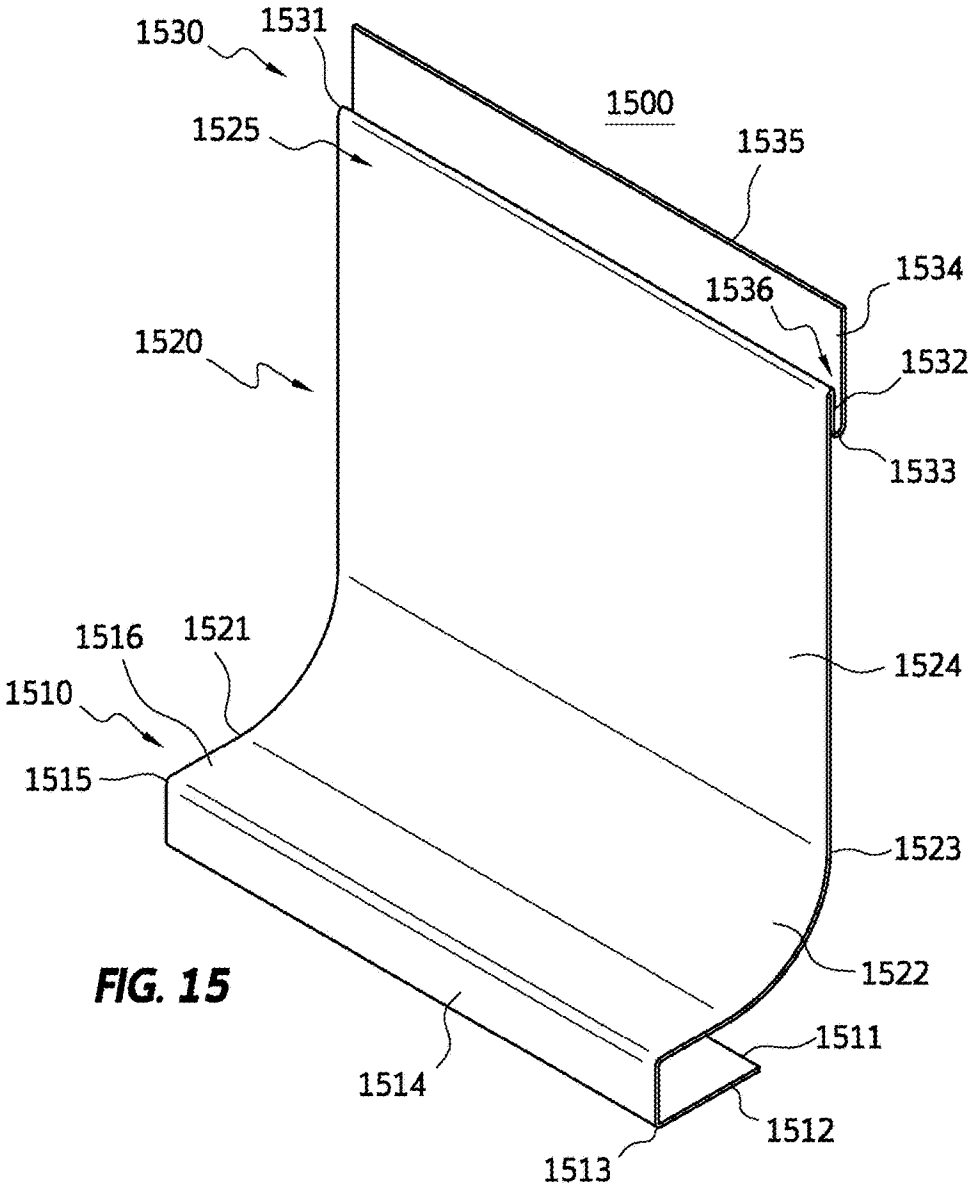
FIG. 15 illustrates a top, front, right side perspective view of a baseboard element, according to an embodiment.

Turning ahead in the drawings, FIG. 15 illustrates a top, front, right side perspective view of a baseboard element 1500, according to an embodiment. FIG. 16 illustrates a right side view bottom of baseboard element 1500. Baseboard element 1500 is merely exemplary and embodiments of the baseboard element are not limited to the embodiments presented herein. The baseboard element can be employed in many different embodiments or examples not specifically depicted or described herein. In a number of embodiments, baseboard element 1500 can include a nose portion 1510, a riser portion 1520, and/or a wall groove portion 1530. In many embodiments, baseboard element 1500 can be formed from a continuous sheet material, such as stainless steel, standard steel grades, aluminum, copper, various alloy combinations, vinyl, polyvinyl chloride (PVC), acrylonitrile butadiene styrene (ABS)—a waterproof (or at least water resistant) material, or another suitable material. For example, nose portion 1510, riser portion 1520, and wall groove portion 1530 can be integral. In other embodiments, baseboard element 1500 can be non-integral. For example, nose portion 1510, riser portion 1520, and/or wall groove portion 1530 can be formed from various different pieces of materials, which can be attached through welding, brazing, adhesive, or other suitable methods.

In many embodiments, nose portion 1510 can include a nose bottom edge 1511, a nose bottom section 1512, a nose bottom bend 1513, a nose face section 1514, a nose top bend 1515, and/or a nose top section 1516. In several embodiments, nose bottom section 1512 can extend from nose bottom edge 1511 to nose bottom bend 1513, and in certain embodiments can be substantially planar. In a number of embodiments, nose face section 1514 can extend from nose bottom bend 1513 to nose top bend 1515, and in certain embodiments can be substantially planar. In various embodiments, nose top section 1516 can extend from nose top bend 1515 to a riser bend bottom interface 1521, and in certain embodiments can be substantially planar. In many embodiments, nose face section 1513 can extend between nose bottom section 1512 at nose bottom bend 1513 and nose top section 1516 at nose top bend 1515. In several embodiments, nose face section 1514 can extend approximately perpendicular to nose bottom section 1512 and nose top section 1516, such that nose bottom bend 1513 and nose top bend 1515 are each approximately 90 degree bends. In other embodiments, nose face section 1514 can extend at other suitable angles with respect to nose bottom section 1512 and/or nose top section 1516, such that nose bottom bend 1513 and/or nose top bend 1515 are bends having other suitable angles. In many embodiments, the angles of nose bottom bend 1513 and nose top bend 1515 can be supplementary angles, such that nose top section 1516 can extend approximately parallel to nose bottom section 1512. In other embodiments, nose top section 1516 can extend at another suitable angle with respect to bottom section 1512.

In various embodiments, riser portion 1520 can include riser bend bottom interface 1521, a riser bend 1522, a riser bend top interface 1523, and/or riser section 1524. In a number of embodiments, riser section 1524 can extend from riser bend top interface 1523 to a groove top bend 1531, and in certain embodiments can be substantially planar. In several embodiments, riser bend 1522 can extend between nose top section 1516 at riser bend bottom interface 1521 and riser section 1524 at riser bend top interface 1523. In various embodiments, riser bend 1522 can have an arcuate shape, such as a 90 degree arc of a circle, or another suitable arcuate shape. In some embodiments, riser bend can form a 90 degree bend, such that riser section 1524 can extend approximately perpendicular to nose top section 1516. In other embodiments riser section can extend at another suitable angle with respect to nose top section 1516.

In several embodiments, wall groove portion 1530 can include groove top bend 1531, a groove front section 1532, a groove bottom bend 1533, a groove bottom bend 1534, and/or a groove top edge 1535. In some embodiments, groove front section 1532 can extend between groove top bend 1531 and groove bottom bend 1533, and in certain embodiments can be substantially planar. In some embodiments, groove top bend 1531 can form a 180 degree bend, such that groove front section 1532 can extend approximately parallel to riser section 1524. For example, in some embodiments, groove top bend 1531 can form a tight 180 degree bend such that groove front section 1532 touches riser section 1524 along a riser overlap portion 1525 of riser section 1524. In other embodiments, groove top bend 1531 can bend at a more relaxed 180 degree bend (e.g., with a larger radius of curvature), such groove front section 1532 does not touch riser section 1524 along riser overlap portion 1525 of riser section 1524, but nonetheless extends approximately parallel to riser section 1524. In yet other embodiments, groove front section 1532 can extend at another suitable angle with respect to riser section 1524.

In some embodiments, groove back section 1534 can extend between groove bottom bend 1533 and groove top edge 1535, and in certain embodiments can be substantially planar. In some embodiments, groove bottom bend 1533 can form a 180 degree bend, such that groove back section 1534 can extend approximately parallel to groove front section 1532. In other embodiments, groove back section 1534 can extend at another suitable angle with respect to groove front section 1532. In a number of embodiments, groove back section 1534 extends upward from groove bottom bend 1533 past the groove top bend 1531 up to groove top edge 1535 such that groove top edge 1535 is higher than groove top bend 1531. In other embodiments, groove top edge 1535 can be at the same height as groove top bend 1531. In yet other embodiments, groove top edge 1535 can be lower than groove top bend 1531, such that groove top edge 1535 is between groove bottom bend 1533 and groove top bend 1531. In several embodiments, groove front section 1532 does not touch groove back section 1534, and a groove 1536 is formed between groove front section 1532 and groove back section 1534. Groove 1536 can have a bottom surface at groove bottom bend 1533, and can have an opening behind groove top bend 1531 between groove front section 1532 and groove back section 1534.

In other embodiments, groove bottom bend 1533 can include two bends (not shown) that are supplementary angles that are separated by a span (not shown). The two bends can each be 90 degree bends, or can be bends of other supplementary angles, such as 135 degrees and 45 degrees, or other suitable angles. The dimensions of the span between the bends can affect the width of groove 1536.

Referring to FIG. 16, in a first embodiment of baseboard element 1500, a height 1601 from nose top section 1516 to groove top bend 1531 can be approximately 6.00 inches (in) (15.24 centimeters (cm), a height 1602 from nose bottom section 1512 to nose top section 1516 can be approximately 0.740 in (1.880 cm), a width 1603 from nose face section 1514 to nose bottom edge 1511 can be approximately 1.280 in (3.251 cm), a width 1604 from nose face section 1514 to riser section 1524 can be approximately 2.125 in (5.398 cm), a height 1605 from groove bottom bend 1533 to groove top bend 1531 can be approximately 0.500 in (1.270 cm), a height 1606 from groove bottom bend 1533 to groove top edge 1535 can be approximately 1.30 in (3.302 cm), a width 1607 from groove front section 1532 to groove back section 1534 (e.g., width of groove 1536) can be approximately 0.100 in (0.254 cm), and a thickness 1608 of the sheet used to form baseboard 1500 can be 0.036 in (0.0914 cm), a radius of curvature 1608 of riser bend 1522 can be approximately 1.00 in (2.540 cm). In a variation of the first embodiment, width 1607 can be different, such as approximately 0.080 (0.2032 cm) to approximately 0.100 (0.254 cm).

In a second embodiment, height 1601 can be approximately 6.00 in (15.24 cm), height 1602 can be approximately 0.690 in (1.753 cm), width 1603 can be approximately 1.22 in (3.000 cm), width 1604 can be approximately 2.10 in (5.344 cm), height 1605 can be approximately 0.500 in (1.270 cm), height 1606 can be approximately 1.30 in (3.302 cm), width 1607 can be approximately 0.100 in (0.254 cm), thickness 1608 can be approximately 0.036 in (0.0914 cm), and radius of curvature 1608 can be approximately 1.00 in (2.540 cm).

In other embodiments, baseboard 1500 can have dimensions with other suitable values, such as within certain ranges. For example, height 1601 can be approximately 2.00 in (5.08 cm) to approximately 48.00 in (121.92 cm), height 1602 can be approximately 0.500 in (0.127 cm) to approximately 1.00 in (2.540 cm), width 1603 can be approximately 1.00 in (2.540 cm) to approximately 4.00 in (10.16 cm), width 1604 can be approximately 1.00 in (2.540 cm) to approximately 5.00 in (12.70 cm), height 1605 can be approximately 0.200 in (0.508 cm) to approximately 2.00 in (5.08 cm), height 1606 can be approximately 0.200 in (0.508 cm) to approximately 5.00 in (12.70 cm), width 1607 can be approximately 0.024 in (0.0610 cm) to approximately 2.00 in (5.08 cm), thickness 1608 can be approximately 0.031 in (0.0610 cm) to approximately 0.060 in (0.1524 cm), and radius of curvature 1609 can be approximately 0.375 in (0.9525 cm) to approximately 10.00 in (25.4 cm).

In some embodiments, height 1601 can be approximately 6.00 in (15.24 cm), height 1602 can be one of: approximately 0.69 in (1.753 cm) or approximately 0.74 in (1.880 cm), height 1605 can be approximately 1.00 in (2.54 cm), width 1607 can be: (a) approximately 1/16 in (0.159 cm) to approximately 1/8 in (0.318 cm) for wall claddings such as fiberglass reinforced plastic (FRP); or (b) approximately 3/4 in (1.905 cm) to approximately 1.00 in (2.540 cm) for wall claddings such as dry walls, and radius of curvature 1609 can be at least approximately 1.00 in (2.54 cm).

Figure 17:
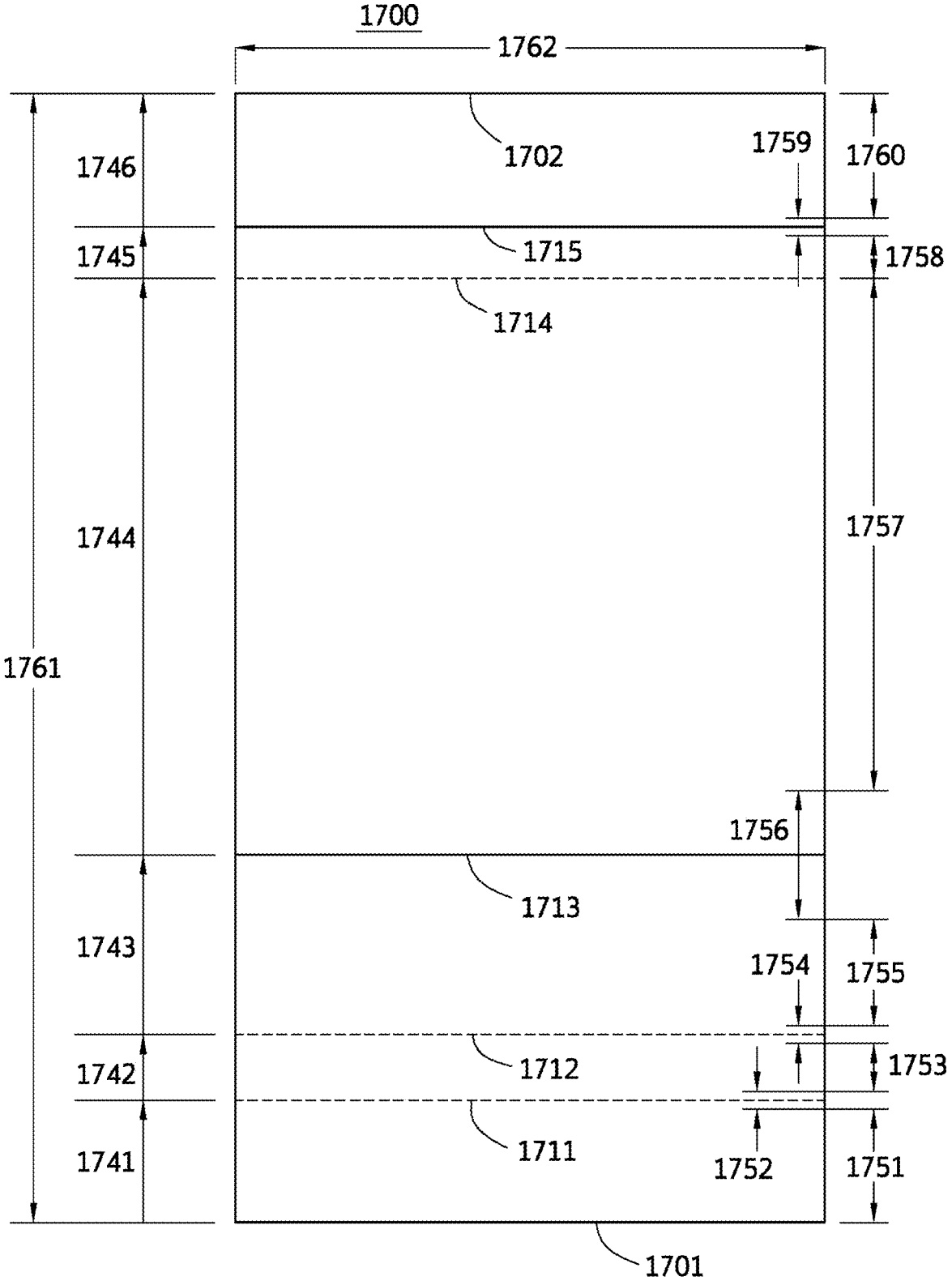
FIG. 17 illustrates a sheet, which can be folded to form the baseboard element of FIG. 15.

Turning ahead in the drawings, FIG. 17 illustrates a sheet 1700, which can be folded to form baseboard element 1500 (FIG. 15-16). Sheet 1700 is merely exemplary and embodiments of the sheet, and location of the folds on the sheet, are not limited to the embodiments presented herein. In a number of embodiments, sheet 1700 can be a continuous sheet material, such as stainless steel or another suitable material. In many embodiments, a direction of the grain can be across the width of sheet 1700. In several embodiments, sheet 1700 can have a height 1761 and a width 1762. Height 1761 can extend from edge 1701 to edge 1702. Edge 1701 can correspond to nose bottom edge 1511 (FIGS. 15-16), and edge 1702 can correspond to groove top edge 1535 (FIGS. 15-16), such as after 1700 is folded to form baseboard element 1500 (FIGS. 15-16). In the first embodiment described above, height 1761 can be approximately 11.50 in (29.21 cm). In the second embodiments described above, height 1760 can be approximately 11.25 in (28.58 cm). In other embodiments, height 1760 can be approximately 6.685 in (16.98 cm) to approximately 66.15 in (168.021 cm). In many embodiments, width 1762 can be any suitable width, such as a width of a wall on which baseboard element 1500 (FIGS. 15-16 is to be installed, or another suitable width.

In many embodiments, sheet 1700 can be folded at five locations to form baseboard element 1500 (FIGS. 15-16). For example, sheet 1700 can be folded at a fold line 1711, a fold line 1712, a fold line 1713, a fold line 1714, and a fold line 1715. Fold lines 1711, 1712, 1713, 1714, and 1715, as shown on FIG. 17, can represent the center (or midpoint) of folds made at each of the fold lines.

Fold line 1711 can correspond to nose bottom bend 1513 (FIGS. 15-16), and can represent a fold downward of 90 degrees centered at a distance 1741 from edge 1701. In the first embodiment described above, distance 1741 can be approximately 1.30 in (3.302 cm) with a radius of curvature of approximately 0.040 in (0.1016 cm). In the second embodiment described above, distance 1741 can be approximately 1.21 in (3.073 cm) with a radius of curvature of approximately 0.040 in (0.1016 cm). In other embodiments, other suitable values for distance 1741 and the radius of curvature of fold line 1711 can be used. In many embodiments, the fold formed at fold line 1711 can result in the creation of span 1751, which can correspond to nose bottom section 1512 (FIGS. 15-16), and a span 1752, which becomes curved and can correspond to nose bottom bend 1513 (FIGS. 15-16).

Fold line 1712 can correspond to nose top bend 1515 (FIGS. 15-16), and can represent a fold downward of 90 degrees centered at a distance 1742 from edge 1701. In the first embodiment described above, distance 1742 can be approximately 2.05 in (5.207 cm) with a radius of curvature of approximately 0.040 in (0.1016 cm). In the second embodiment described above, distance 1742 can be approximately 1.88 in (4.775 cm) with a radius of curvature of approximately 0.040 in (0.1016 cm). In other embodiments, other suitable values for distance 1742 and the radius of curvature of fold line 1712 can be used. In many embodiments, the fold formed at fold line 1712 can result in the creation of span 1753, which can correspond to nose face section 1514 (FIGS. 15-16), and a span 1754, which becomes curved and can correspond to nose top bend 1515 (FIGS. 15-16).

Fold line 1713 can correspond to riser bend 1522 (FIGS. 15-16), and can represent a fold upward of 90 degrees centered at a distance 1743 from edge 1701. In the first embodiment described above, distance 1743 can be approximately 3.96 in (10.06 cm) with a radius of curvature of approximately 1.00 in (2.540 cm). In the second embodiment described above, distance 1743 can be approximately 3.67 in (9.322 cm) with a radius of curvature of approximately 1.16 in (2.95 cm). In other embodiments, other suitable values for distance 1743 and the radius of curvature of fold line 1713 can be used. In many embodiments, the fold formed at fold line 1713 can result in the creation of span 1755, which can correspond to nose top section 1516 (FIGS. 15-16), and a span 1756, which becomes curved and can correspond to riser bend 1522 (FIGS. 15-16).

Fold line 1714 can correspond to groove top bend 1531 (FIGS. 15-16), and can represent a fold downward of 180 degrees centered at a distance 1744 from edge 1701. In the first embodiment described above, distance 1744 can be approximately 9.74 in (24.74 cm) with a radius of curvature of approximately 0.000 in (0.00 cm). In the second embodiment described above, distance 1744 can be approximately 9.41 in (23.90 cm) with a radius of curvature of approximately 0.000 in (0.00 cm). In other embodiments, other suitable values for distance 1744 and the radius of curvature of fold line 1714 can be used. In many embodiments, the fold formed at fold line 1714 can result in the creation of span 1757, which can correspond to riser section 1524 (FIGS. 15-16), and the curve at fold line 1714 can correspond to groove top bend 1531 (FIGS. 15-16).

Fold line 1715 can correspond to groove bottom bend 1533 (FIGS. 15-16), and can represent a fold upward of 180 degrees centered at a distance 1745 from edge 1701. In the first embodiment described above, distance 1745 can be approximately 10.25 in (26.04 cm) with a radius of curvature of approximately 0.050 in (0.127 cm). In the second embodiment described above, distance 1745 can be approximately 9.93 in (25.22 cm) with a radius of curvature of approximately 0.050 in (0.127 cm). In other embodiments, other suitable values for distance 1745 and the radius of curvature of fold line 1715 can be used. In many embodiments, the fold formed at fold line 1715 can result in the creation of span 1758, which can correspond to groove front section 1532 (FIGS. 15-16); a span 1759, which becomes curved and can correspond to groove bottom bend 1533 (FIGS. 15-16); and a span 1760, which extends up to edge 1702, and can correspond to groove back section 1534 (FIGS. 15-16).

Figure 18:
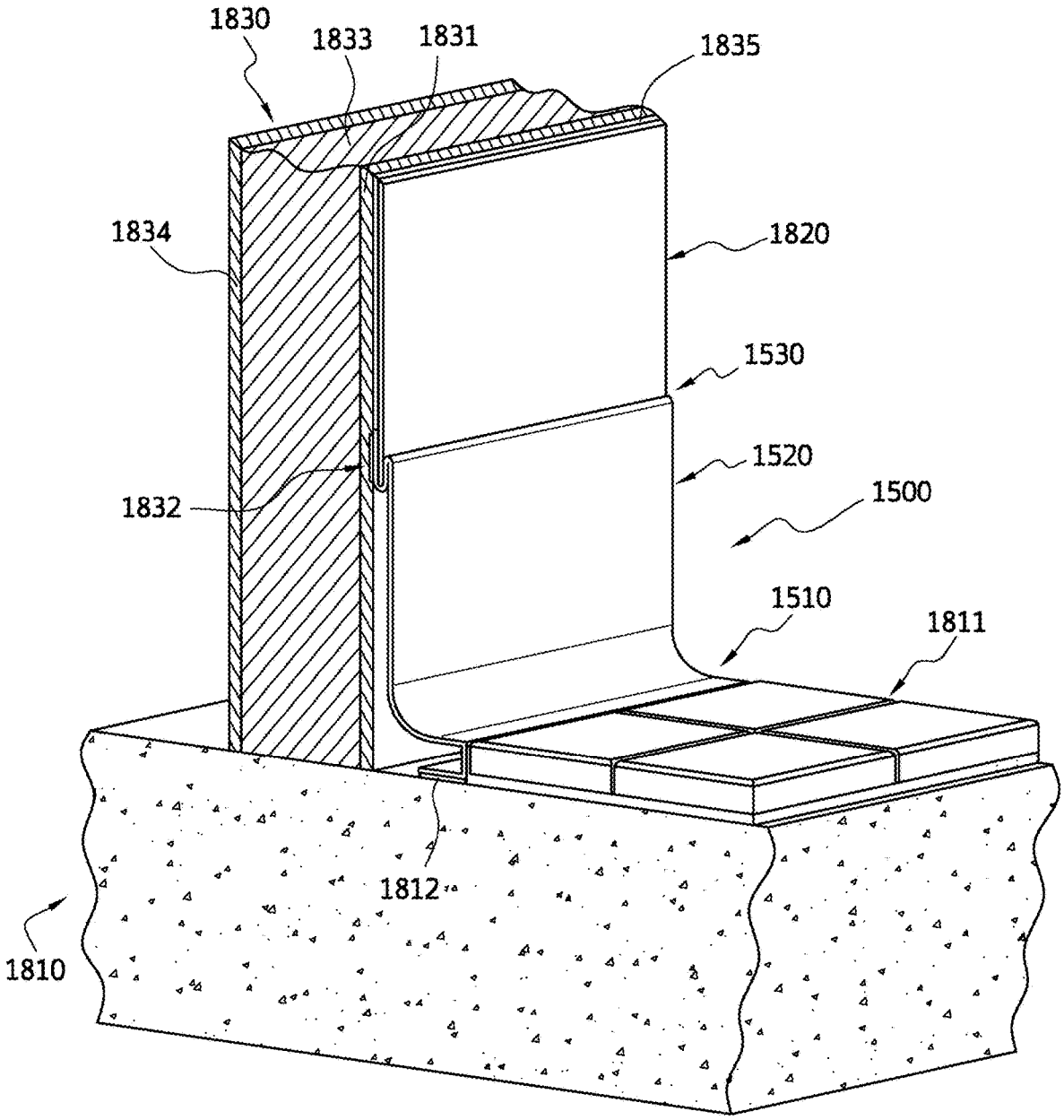
FIG. 18 illustrates a top, front, left side perspective view of the baseboard element of FIG. 15 attached to a flooring base and holding a wall cladding against a wall using a sealant indentation in a wallboard.
Figure 19:
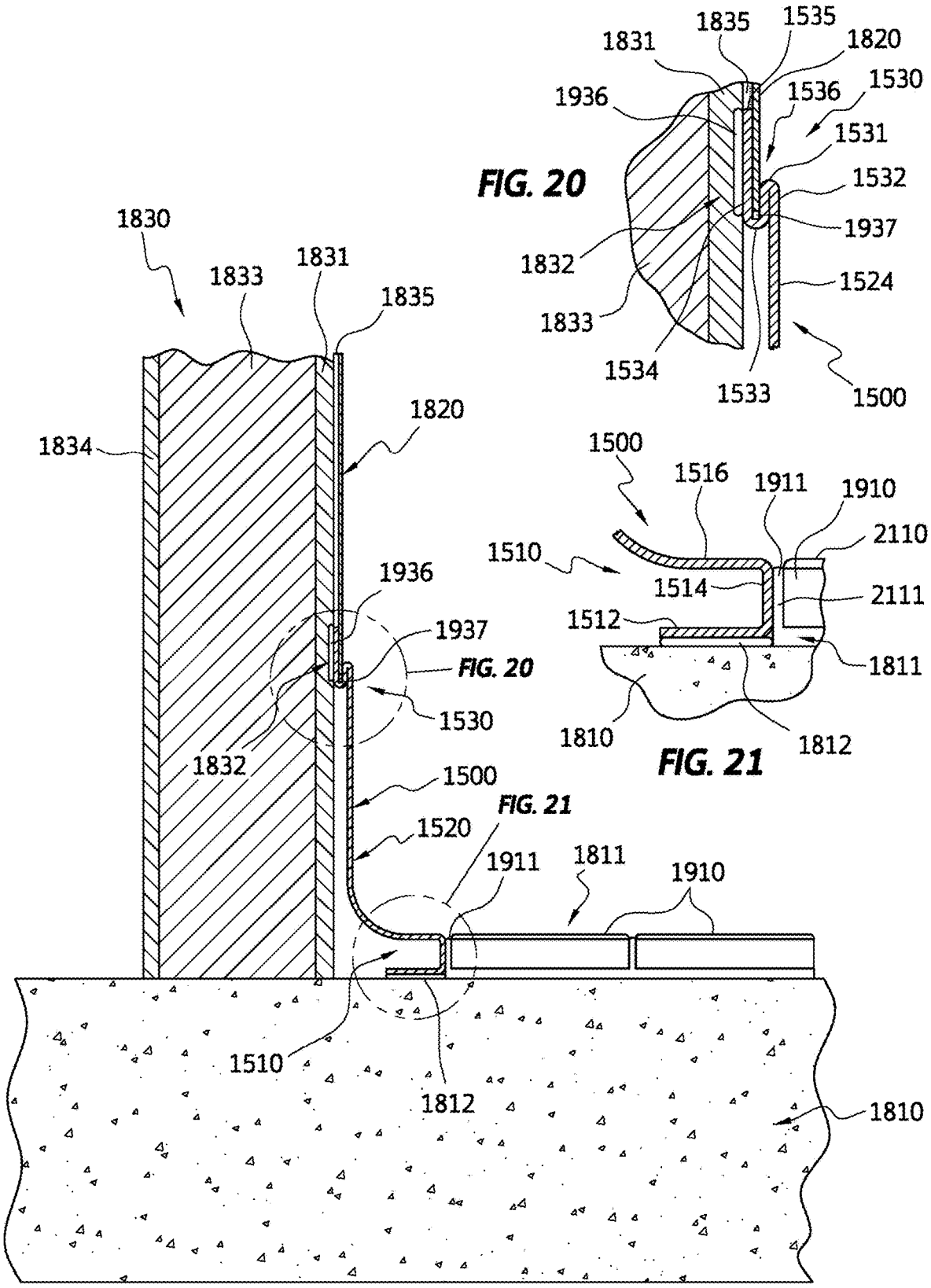
FIG. 19 illustrates a left side view of the baseboard element of FIG. 15 attached to the flooring base of FIG. 18 and holding the wall cladding of FIG. 18 against the wall of FIG. 18 using the sealant indentation of FIG. 18 in the wallboard of FIG. 18.

Turning ahead in the drawings, FIG. 18 illustrates a top, front, left side perspective view of baseboard element 1500 attached to a flooring base 1810 and holding a wall cladding 1820 against a wall 1830 using a sealant indentation 1832 in a wallboard 1831. FIG. 19 illustrates a left side view of baseboard element 1500 attached to flooring base 1810 and holding wall cladding 1820 against wall 1830 using sealant indentation 1832 in wallboard 1831. FIG. 20 illustrates an enlarged left side view of a portion of baseboard element 1500 holding wall cladding 1820 against wall 1830 using sealant indentation 1832 in wallboard 1831, as identified in FIG. 19. FIG. 21 illustrates an enlarged left side view of a portion of baseboard element 1500 attached to flooring base 1810, as identified in FIG. 19. Wall 1830 typically includes one or more wall studs, such as stud 1833, between wallboards, such as wallboard 1831 and a wallboard 1832. The wall studs (e.g., stud 1833) can be wood, steel, or another suitable material. Wallboard (e.g., 1831, 1832) can be gypsum board, gypsum panel, cement board, fiber cement siding (e.g. Hardie board), or another suitable material. Wall cladding 1820 can cover wallboard 1831, and can be a planar wall material made of fiberglass reinforced plastic (FRP), stainless steel, plastic, galvanized steel, copper, glass, or another suitable material. Flooring base 1810 can be a substrate, which can be concrete, cement, wood, plywood, hardboard, or another suitable substrate. A tile flooring 1811 can be laid on flooring base 1810, which can include tiles 1910 and grout 1911. Tiles 1910 can be ceramic tile, stone, glass tile, quarry tile, travertine, or another suitable tile, with grout 1911 used to hold and fill in the spaces between tiles 1910.

In many embodiments, baseboard element 1500 can be used to hold wall cladding 1820, such as in a watertight manner, to keep water from penetrating wall 1830 and/or down to flooring base 1810. For example, wall groove portion 1530 can be configured to hold wall cladding 1820 in groove 1536, such as between groove front section 1532 and grove back section 1534, as shown in FIG. 20. In a number of embodiments, wall groove portion 1530 can be configured to hold wall cladding 1820 in groove 1536 in a watertight manner by sizing a snug fit (e.g., a friction fit) within groove 1536, and/or by using sealant 1937 around wall cladding 1820 within groove 1536. For example, sealant 1937 be applied between the bottom of wall cladding 1830 and groove lower bend 1533, as shown in FIG. 20.

In a number of embodiments, wall cladding 1820 can be attached to wallboard 1831 using an adhesive 1835, or in other embodiments, using another type of fastener, such as screws, rivets, bolts, etc. In some embodiments, such as shown in FIG. 18-20, wall groove portion 1530 can be attached to wallboard 1831 using an adhesive 1936 in sealant indentation 1832 in wallboard 1831.

In several embodiments, baseboard element 1500 can be used to attach to flooring base 1810 in conjunction with tile flooring 1811, which in many embodiments can be done in a watertight manner to keep water from penetrating down to floor 1810 and/or back to wall 1830. In several embodiments, such as shown in FIG. 21, nose bottom section 1512 can be configured to be attached to flooring base 1810, such as by using a sealant 1812 between nose bottom section 1510 and flooring base 1810. In several embodiments, nose top section 1516 can be configured to be approximately coplanar with a top 2110 of tile flooring 1811 that is laid on flooring base 1810 when nose bottom section 1512 is attached to flooring base 1810. In many embodiments, nose face section 1514 can be configured to abut a thickness side 2111 of tile flooring 1811 and be grouted, such as using grout 1911, to tile flooring 1811 and/or tiles 1910 when nose bottom section 1512 is attached to flooring base 1810.

Figure 23:
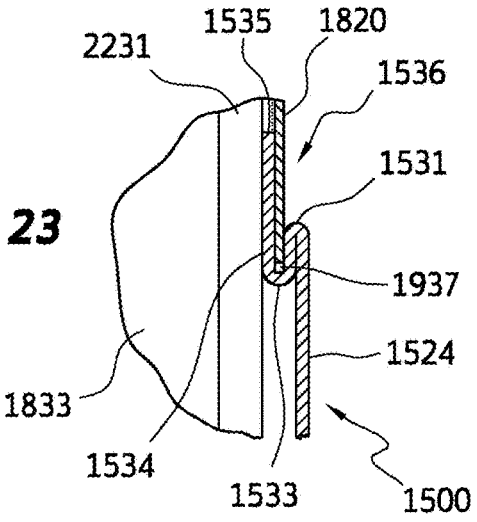
FIG. 23 illustrates an enlarged left side view of a portion of the baseboard element of FIG. 15 holding the wall cladding of FIG. 18 against the wall of FIG. 22, as identified in FIG. 22.
Figure 22:
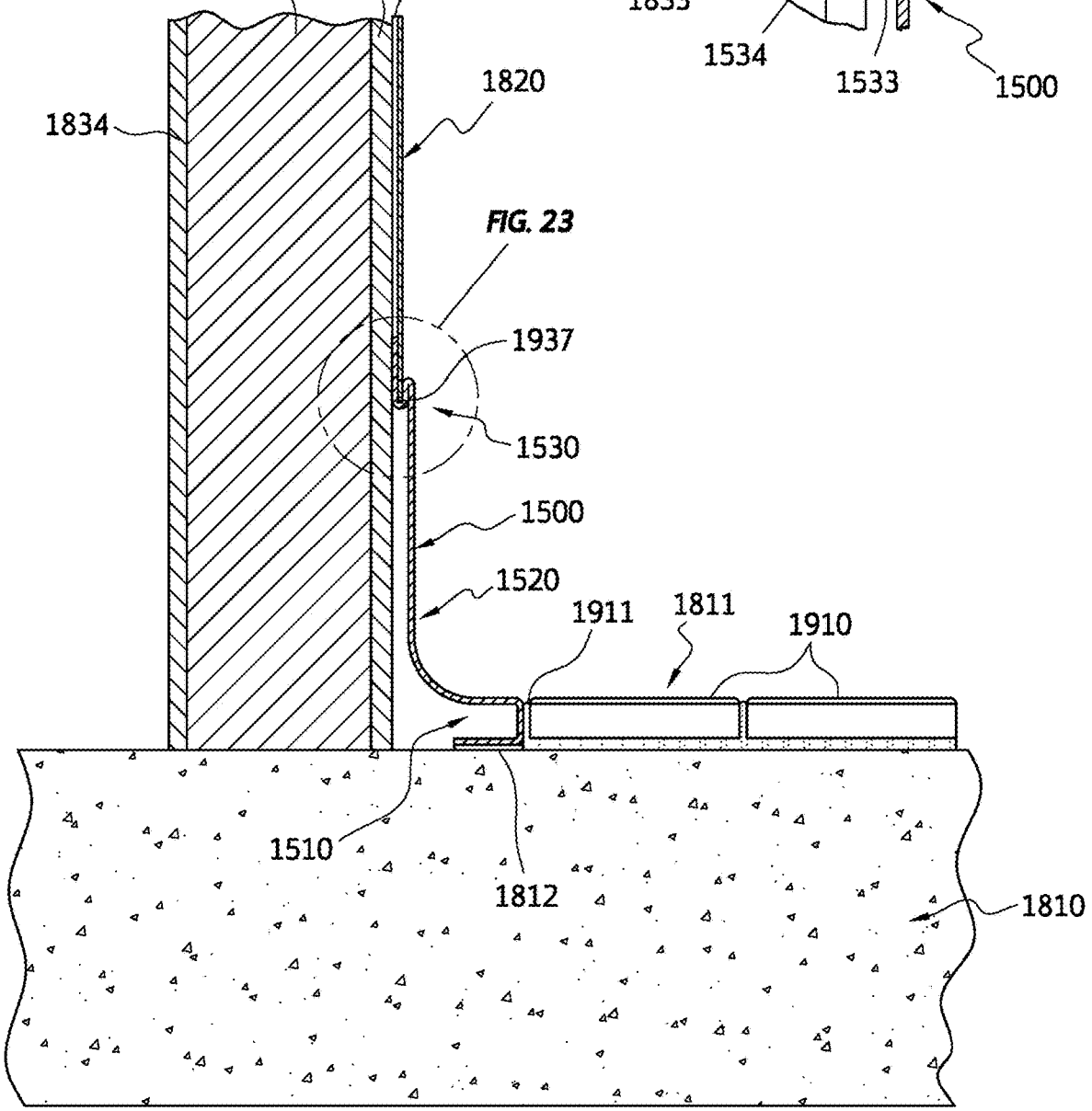
FIG. 22 illustrates a left side view of the baseboard element of FIG. 15 attached to the flooring base of FIG. 18 and holding the wall cladding of FIG. 18 against a wall without a sealant indentation in a wallboard.

Turning ahead in the drawings, FIG. 22 illustrates a left side view of baseboard element 1500 attached to flooring base 1810 and holding wall cladding 1820 against a wall 2230 without a sealant indentation in a wallboard 2231. FIG. 23 illustrates an enlarged left side view of a portion of baseboard element 1500 holding wall cladding 1820 against wall 2230, as identified in FIG. 22. Wall 2230 is similar to wall 1830, and includes wallboard 1834, and one or more studs, such as stud 1833, but in place of wallboard 1831, which included sealant indentation 1832, instead includes a wallboard 2231 that does not include a sealant indentation. Wall 2230 also includes wall cladding 1820, but wall cladding 1820 can be attached to wallboard 2231 using sealant 2235, or affixed in another suitable manner, such as using screws, rivets, bolts, adhesives, etc. In many embodiments, wall groove portion 1530 can be held to wallboard 2231 by attaching wall cladding 1820 to wallboard 2231 while wall cladding is inserted in groove 1536, and in many embodiments, while baseboard element 1500 also is attached to flooring base 1810 (e.g., with sealant 1812) and grouted to tile flooring 1811 (e.g., with grout 1911), as described above.

Figure 25:
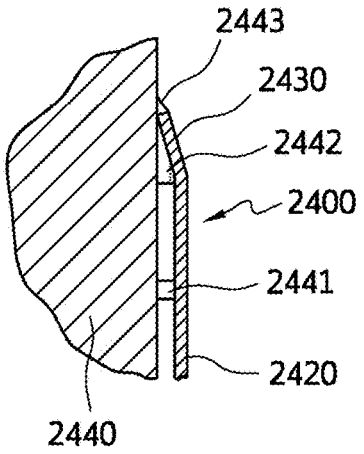
FIG. 25 illustrates an enlarged left side view of a portion of the baseboard element of FIG. 24 attached to the wall of FIG. 24, as identified in FIG. 24.
Figure 24:
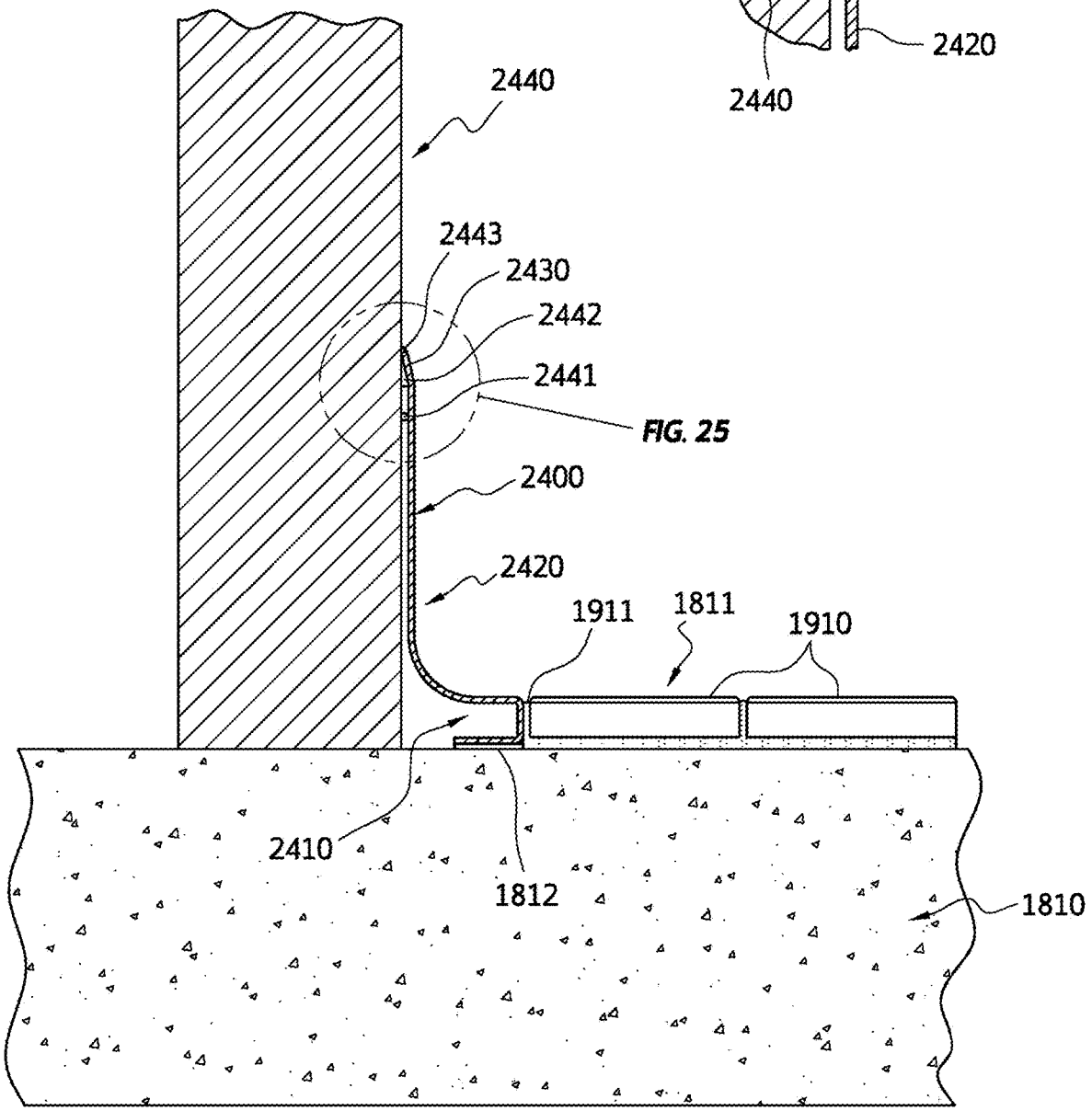
FIG. 24 illustrates a left side view of a baseboard element attached to the flooring base of FIG. 18 and a wall without a wall cladding.

Turning ahead in the drawings, FIG. 24 illustrates a left side view of a baseboard element 2400 attached to flooring base 1810 and a wall 2440 without a wall cladding. FIG. 25 illustrates an enlarged left side view of a portion of baseboard element 2400 attached to wall 2440, as identified in FIG. 24. Wall 2440 can be a wall similar to wall 2230, but without a wall cladding (e.g., wall cladding 1820). In some embodiments, wall 2440 can be a metal wall, such as a galvanized wall on a refrigerated cooler, or other suitable form of wall.

Baseboard element 2400 can be similar to baseboard element 1500 (FIGS. 15-16), and can include a nose portion 2410, a riser portion 2420, and a wall portion 2430. Nose portion 2410 can be similar or identical to nose portion 1510 (FIGS. 15-16), and various elements of nose portion 2410 can be similar or identical to various elements of nose portion 1510 (FIGS. 15-16). Riser portion 2420 can be similar or identical to riser portion 1520 (FIGS. 15-16), and various elements of riser portion 2420 can be similar or identical to various elements of riser portion 1520 (FIGS. 15-16). Wall portion 2430 can be different from wall portion 2430 (FIGS. 15-16). As shown in FIG. 24-25, wall portion 2430 can extend at a chamfered angle with respect to riser portion 2420.

In many embodiments, baseboard element 2400 can be attached to flooring base 1810 with nose portion 2410 (e.g., with sealant 1812) and grouted to tile flooring 1811 (e.g., with grout 1911), as described above for nose portion 1510 (FIGS. 15-16). As shown in FIGS. 24-25, baseboard element 2400 can be attached to wall 2440 using a fastener 2441, a sealant 2442, and/or a sealant 2443. Fastener 2441 can be a mounting screw, a bolt, a rivet, or other suitable fastener, and can attach riser portion 2420 to wall 2440. Sealant 2442 can be placed between wall portion 2430 and wall 2440, in the angled region between wall 2440 and wall portion 2430. Sealant 2443 can be placed above wall portion 2430 to attached baseboard element 2400 to wall 2440, such as in a watertight manner to keep water from penetrating wall 2440 and/or down to floor base 1810.

Figure 26:
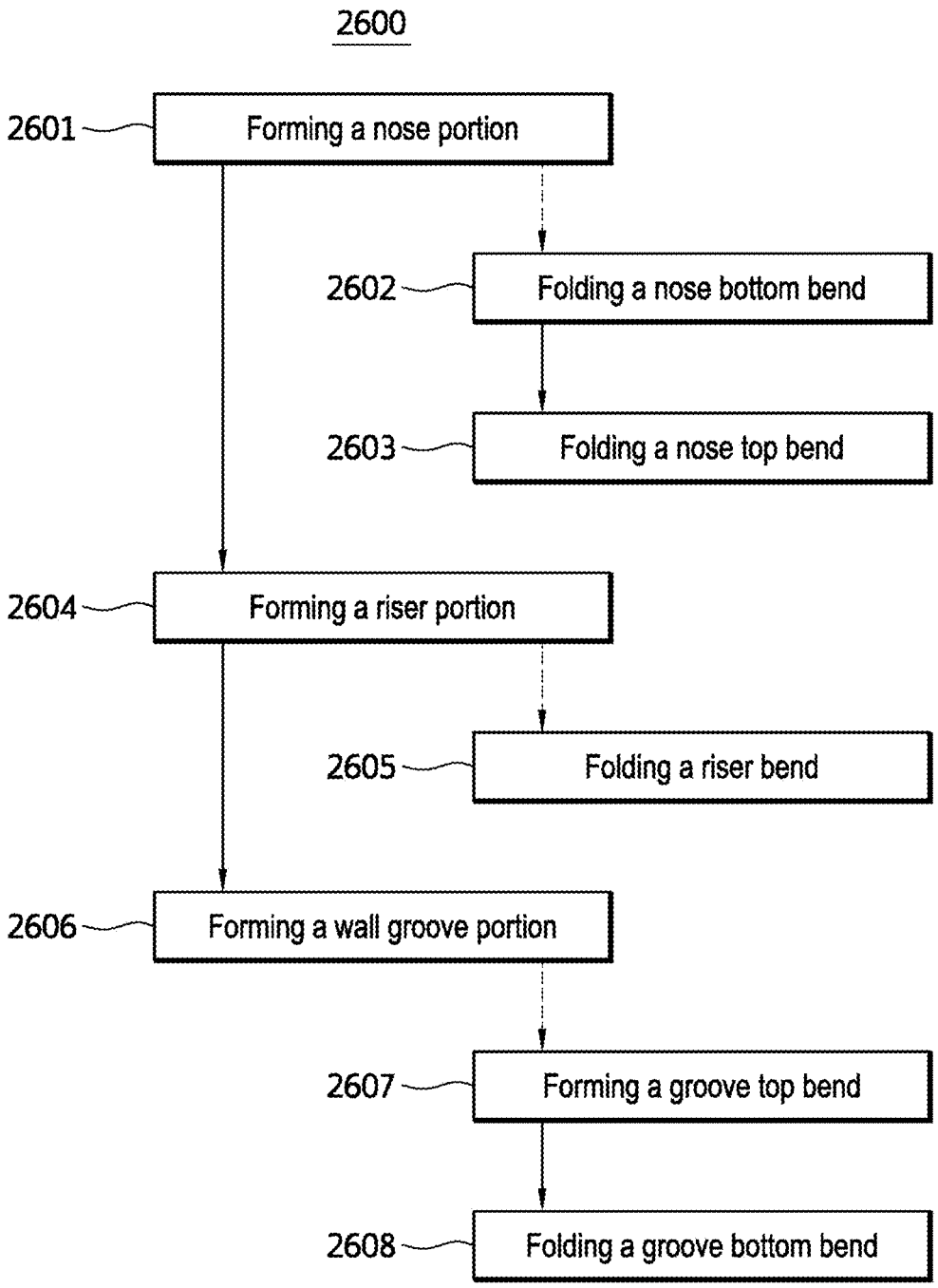
FIG. 26 illustrates a flow chart for a method 2600 of providing a baseboard element, according to another embodiment.

Turning ahead in the drawings, FIG. 26 illustrates a flow chart for a method 2600. In many embodiments, method 2600 can be a method of providing, forming, and/or manufacture a baseboard element in accordance with the present disclosure. Method 2600 is merely exemplary and is not limited to the embodiments presented herein. Method 2600 can be employed in many different embodiments or examples not specifically depicted or described herein. In some embodiments, the procedures, the processes, and/or the activities of method 2600 can be performed in the order presented. In other embodiments, the procedures, the processes, and/or the activities of method 2600 can be performed in any suitable order. In still other embodiments, one or more of the procedures, the processes, and/or the activities of method 2600 can be combined or skipped. In some examples, the baseboard element can be similar to baseboard element 1500 (FIGS. 15-16) and/or baseboard element 2400 (FIGS. 24-25).

Referring to FIG. 26, method 2600 can include block 2601 of forming a nose portion. The nose portion can be similar or identical to nose portion 1510 (FIGS. 15-16) and/or nose portion 2410 (FIG. 24). In several embodiments, the nose portion can be formed from a sheet of continuous material, such as sheet 1700 (FIG. 17).

In some embodiments, block 2601 of forming a nose portion can include a block 2602 of folding a nose bottom bend between a nose bottom section and a nose face section. The nose bottom bend can be similar or identical to nose bottom bend 1513 (FIGS. 15-16). The nose bottom section can be similar or identical to nose bottom section 1512 (FIGS. 15-16). The nose face section can be similar or identical to nose face section 1514 (FIGS. 15-16). In several embodiments, block 2602 of folding a nose bottom bend between a nose bottom section and a nose face section can be performed by press brakes bending, roll bending, roll forming, draw bench forming, stretch forming, extrusion, or another suitable form of bending a sheet of continuous material, such as at fold line 1711 (FIG. 17) of sheet 1700 (FIG. 17). In other embodiments, the nose bottom bend can be formed via casting, forging, milling, machining, and/or other processes.

In some embodiments, block 2601 of forming a nose portion also can include a block 2603 of folding a nose top bend between the nose face section and a nose top section. The nose top bend can be similar or identical to nose top bend 1515 (FIGS. 15-16). The nose face section can be similar or identical to nose face section 1514 (FIGS. 15-16). The nose top section can be similar or identical to nose top section 1516 (FIGS. 15-16). In several embodiments, block 2603 of folding a nose top bend between the nose face section and a nose top section can be performed by press brakes bending, roll bending, roll forming, draw bench forming, stretch forming, extrusion, or another suitable form of bending a sheet of continuous material, such as at fold line 1712 (FIG. 17) of sheet 1700 (FIG. 17). In other embodiments, the nose top bend can be formed via casting, forging, milling, machining, and/or other processes.

In several embodiments, the nose top section can extend approximately parallel to the nose bottom section. In a number of embodiments, the nose face section can extend between the nose bottom section at the nose bottom bend and the nose top section at the nose top bend. In several embodiments, the nose face section can extend approximately perpendicular to the nose bottom section and the nose top section.

In a number of embodiments, the nose bottom section can be configured to be attached to a flooring base. The flooring base can be similar or identical to flooring base 1810 (FIG. 18). In many embodiments, the nose bottom section can be attached to the flooring base using an adhesive, such as sealant 1812 (FIG. 18). In several embodiments, the nose top section can be configured to be approximately coplanar with a top of a tile flooring that is laid on the flooring base when the nose bottom section is attached to the flooring base. The tile flooring can be similar or identical to tile flooring 1811 (FIG. 18), and the top of the tile flooring can be similar or identical to top 2110 (FIG. 21) of tile flooring 1811 (FIG. 18). In several embodiments, the nose face section can be configured to abut a thickness side of the tile flooring and be grouted to the tile flooring when the nose bottom section is attached to the flooring base. The thickness side of the tile flooring can be similar or identical to thickness side 2111 (FIG. 21) of tile flooring 1811 (FIG. 18). In a number of embodiments, the nose face section can be grouted to the tile flooring, such as by using grout 1911 (FIGS. 19, 21).

In many embodiments, method 2600 also can include block 2604 of forming a riser portion. The riser portion can be similar or identical to riser portion 1520 (FIGS. 15-16) and/or riser portion 2420 (FIG. 24). In several embodiments, the riser portion can be formed from a sheet of continuous material, such as sheet 1700 (FIG. 17).

In some embodiments, block 2604 of forming a riser portion can include a block 2605 of folding a riser bend between the nose top section of the nose portion and a riser section. The riser bend can be similar or identical to riser bend 1522 (FIGS. 15-16). The riser section can be similar or identical to riser section 1524 (FIGS. 15-16). In several embodiments, block 2605 of folding a riser bend between a nose top section and a riser section can be performed by press brakes bending, roll bending, roll forming, draw bench forming, stretch forming, extrusion, or another suitable form of bending a sheet of continuous material, such as at fold line 1713 (FIG. 17) of sheet 1700 (FIG. 17). In other embodiments, the riser bend can be formed via casting, forging, milling, machining, and/or other processes. In various embodiments, the riser section can extend approximately perpendicular to the nose top section. In some embodiments, a radius of curvature of the riser bend can be approximately 0.500 in (1.27 cm) to 2.00 in (5.08 cm).

In many embodiments, method 2600 additionally can include block 2606 of forming a wall groove portion. The wall groove portion can be similar or identical to wall groove portion 1530 (FIGS. 15-16). In other embodiments, method 2600 can include forming a wall portion, such as wall portion 2430 (FIGS. 24-25). In several embodiments, the wall groove portion can be formed from a sheet of continuous material, such as sheet 1700 (FIG. 17). In many embodiments, the nose portion, the riser portion, and the wall groove portion can be integral, such as all formed by sheet 1700 (FIG. 17).

In some embodiments, block 2606 of forming a wall groove portion can include a block 2607 of folding a groove top bend between the riser section of the riser portion and a groove front section. The groove top bend can be similar or identical to groove top bend 1531 (FIGS. 15-16). The groove front section can be similar or identical to groove front section 1532 (FIGS. 15-16). In several embodiments, block 2607 of folding a groove top bend between the riser section of the riser portion and a groove front section can be performed by press brakes bending, roll bending, roll forming, draw bench forming, stretch forming, extrusion, or another suitable form of bending a sheet of continuous material, such as at fold line 1714 (FIG. 17) of sheet 1700 (FIG. 17). In other embodiments, the groove top bend can be formed via casting, forging, milling, machining, and/or other processes. In several embodiments, the groove front section can extend approximately parallel to the riser section of the riser portion. In several embodiments, a height from the nose top section to the groove top bend can be approximately 4.00 in (10.16 cm) to approximately 8.00 in (20.32 cm).

In many embodiments, block 2606 of forming a wall groove portion can include a block 2608 of folding a groove bottom bend between the groove front section and a groove back section. The groove bottom bend can be similar or identical to groove bottom bend 1533 (FIGS. 15-16). The groove back section can be similar or identical to groove back section 1534 (FIGS. 15-16). In several embodiments, block 2608 of folding a groove bottom bend between the groove front section and a groove back section can be performed by press brakes bending, roll bending, roll forming, draw bench forming, stretch forming, extrusion, or another suitable form of bending a sheet of continuous material, such as at fold line 1715 (FIG. 17) of sheet 1700 (FIG. 17). In other embodiments, the groove bottom bend can be formed via casting, forging, milling, machining, and/or other processes.

In several embodiments, the groove back section can extend approximately parallel to the groove front section. In a number of embodiments, the groove back section can extend upward from the groove bottom bend past the groove top bend. In several embodiments, the wall groove portion can be configured to hold a planar wall material between the groove front section and the groove back section. The planar wall material can be similar or identical to wall cladding 1820 (FIG. 18). In many embodiments, the wall groove portion can be configured to hold the planar wall material in a watertight manner.

In the foregoing specification, construction elements have been described with reference to a number of exemplary embodiments. Various modifications and changes may be made, however, without departing from the scope of the construction element as set forth in the claims. The specification and figures are illustrative, rather than restrictive, and modifications are intended to be included within the scope of any construction element. Accordingly, the scope of any construction element should be determined by the claims and their legal equivalents rather than by merely the exemplary embodiments described.

For example, the steps recited in any method or process claims may be executed in any order and are not limited to the specific order presented in the claims. Additionally, the components and/or elements recited in any physical embodiment claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes", "is" or any variation thereof, are intended to reference a non-exclusive inclusion, such that a process, method, article, composition, system, device, or apparatus that comprises a list of elements does not include only those elements recited, but may also include other elements not expressly listed or inherent to such process, method, article, composition, system, device, or apparatus. Other combinations and/or modifications of the above-described structures, arrangements, applications, proportions, elements, materials or components used in the practice of a construction element, in addition to those not specifically recited, may be varied or otherwise particularly adapted to specific environments, manufacturing specifications, design parameters or other operating requirements without departing from the general principles of the same.

Although the baseboard elements and related method have been described with reference to specific embodiments, it will be understood by those skilled in the art that various changes may be made without departing from the spirit or scope of the disclosure. Accordingly, the disclosure of embodiments is intended to be illustrative of the scope of the disclosure and is not intended to be limiting. It is intended that the scope of the disclosure shall be limited only to the extent required by the appended claims. For example, to one of ordinary skill in the art, it will be readily apparent that any element of FIGS. 1-26 may be modified, and that the foregoing discussion of certain of these embodiments does not necessarily represent a complete description of all possible embodiments. For example, one or more of the procedures, processes, or activities of FIG. 26 may include different procedures, processes, and/or activities and be performed by many different modules, in many different orders.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A baseboard element comprising:

a nose portion comprising a nose bottom section and a nose face section coupled to the nose bottom section;

a riser portion comprising a riser section extending approximately perpendicular to the nose bottom section and a riser bend coupled to the nose portion, wherein the riser section is substantially planar and defines a plane; and a wall groove portion coupled to the riser portion, wherein:

(1) the nose portion is positioned only on a first side of the plane defined by the riser section;

(2) the wall groove portion is positioned only on a second side of the plane defined by the riser section, the second side opposite the first side of the plane defined by the riser section;

(3) the nose bottom section comprises a nose bottom edge at a terminal end of the nose bottom section, without any structure of the baseboard element extending beyond the terminal end from the terminal end; and (4) the nose bottom edge of the nose bottom section is approximately at the plane or closer to the plane than the nose face section is to the plane.

2. The baseboard element of claim 1, wherein:

the nose bottom section is configured to be coupled to a flooring base of a building.

3. The baseboard element of claim 1, wherein:

the wall groove portion further comprises a groove back section having a groove back section front surface and a groove back section back surface opposite the groove back section front surface; and the wall groove portion is configured to receive a cladding, such that:

the groove back section back surface is configured to be coupled to a vertical structure of a building; and a cladding back surface of the cladding is opposite a cladding front surface of the cladding and is coupled to the vertical structure of the building when the nose bottom section is coupled to a flooring base of the building and when the groove back section back surface is coupled to the vertical structure of the building and when a portion of the cladding is located within the wall groove portion.

4. The baseboard element of claim 1, wherein:

the wall groove portion further comprises a groove front section, a groove back section, a groove bottom bend extending between the groove front section and the groove back section, and a groove top bend extending between the groove front section and the riser portion; and the groove back section extends upward from the groove bottom bend past the groove top bend.

5. The baseboard element of claim 1, wherein:

the nose portion further comprises a nose top section coupled to the nose face section and to the riser portion;

the wall groove portion further comprises a groove front section, a groove back section, a groove bottom bend extending between the groove front section and the groove back section, and a groove top bend extending between the groove front section and the riser portion;

a radius of curvature of the riser bend is approximately 0.500 in (1.27 cm) to approximately 2.00 in (5.08 cm);

a height extending from the nose top section to the groove top bend is approximately 2.00 in (5.08 cm) to approximately 48.00 in (121.92 cm);

a height extending from the nose bottom section to the nose top section is approximately 0.500 to approximately 1.00 inch;

a width extending from the nose face section to the nose bottom edge is approximately 1.00 in (2.540 cm) to approximately 4.00 in (10.16 cm);

a width extending from the nose face section to the riser section is approximately 1.00 in (2.540 cm) to approximately 5.00 in (12.70 cm);

a height extending from the groove top bend to the groove bottom bend is approximately 0.200 in (0.508 cm) to approximately 2.00 in (5.08 cm);

a height extending from the groove bottom bend to a groove top edge at a distal end of the groove back section opposite the groove bottom bend is approximately 0.200 in (0.508 cm) to approximately 5.00 in (12.70 cm);

a width extending from the groove front section to the groove back section is approximately 0.024 in (0.0610 cm) to approximately 2.00 in (5.08 cm); and a thickness of the riser section is approximately 0.031 in (0.0610 cm) to approximately 0.060 in (0.1524 cm).

6. The baseboard element of claim 1, wherein:

the nose portion further comprises a nose top section coupled to the nose face section; and a height extending from the nose bottom section to the nose top section is approximately 0.69 in (1.753 cm) or approximately 0.74 in (1.880 cm).

7. The baseboard element of claim 1, wherein:

the wall groove portion further comprises a groove front section and a groove back section coupled to the groove front section; and a width extending from the groove front section to the groove back section is one of:

approximately 1/16 in (0.159 cm) to approximately 1/8 in (0.318 cm); or approximately 3/4 in (1.905 cm) to approximately 1.00 in (2.540 cm).

8. The baseboard element of claim 1, wherein:

a height from a nose top section of the nose portion to a groove top bend of the wall groove portion is approximately 6 in (15.24 cm).

9. The baseboard element of claim 1, wherein:

the wall groove portion further comprises a groove bottom bend and a groove top bend coupled to the groove bottom bend; and a height extending from the groove top bend to the groove bottom bend is approximately 1.00 in (2.54 cm).

10. The baseboard element of claim 1, wherein:

the riser bend comprises a substantially arcuate shape; and a radius of curvature of the riser bend is at least approximately 1.00 in (2.54 cm).

11. A method of providing a baseboard element, comprising:

forming a nose portion, comprising:

folding a nose bottom bend between a nose bottom section and a nose face section;

forming a riser portion, comprising:

folding a riser bend between the nose portion and a riser section, the riser section (1) extending approximately perpendicular to the nose bottom section, (2) being substantially planar, and (3) defining a plane, wherein the nose portion is located only on a first side of the plane defined by the riser section; and forming a wall groove portion coupled to the riser portion and located only on a second side of the plane defined by the riser section, the second side opposite the first side of the plane defined by the riser section, wherein:

(1) the nose bottom section comprises a nose bottom edge at a terminal end of the nose bottom section, without any structure of the baseboard element extending beyond the terminal end from the terminal end; and (2) the nose bottom edge of the nose bottom section is approximately at the plane or closer to the plane than the nose face section is to the plane.

12. The method of claim 11, wherein:

the nose bottom section is configured to be coupled to a flooring base of a building.

13. The method of claim 11, wherein:

forming the wall groove portion further comprises folding a groove bottom bend between a groove front section of the wall groove portion and a groove back section of the wall groove portion, the groove back section having a groove back section front surface and a groove back section back surface opposite the groove back section front surface; and the wall groove portion is configured to receive a cladding, such that:

(1) the groove back section back surface is configured to be coupled to a vertical structure of a building; and (2) a cladding back surface of the cladding is opposite a cladding front surface of the cladding and is coupled to the vertical structure of the building when the nose bottom section is coupled to a flooring base of the building and when the groove back section back surface is coupled to the vertical structure of the building and when a portion of the cladding is located within the wall groove portion.

14. The method of claim 11, wherein:

forming the wall groove portion further comprises:

folding a groove top bend between the riser section of the riser portion and a groove front section of the wall groove portion; and folding a groove bottom bend between the groove front section and a groove back section of the wall groove portion; and the groove back section extends upward from the groove bottom bend past the groove top bend.

15. The method of claim 11, wherein:

forming the nose portion further comprises folding a nose top bend between the nose face section and a nose top section opposite the nose bottom section;

forming the wall groove portion further comprises:

folding a groove top bend between the riser section of the riser portion and a groove front section of the wall groove portion; and folding a groove bottom bend between the groove front section and a groove back section of the wall groove portion; and the baseboard element further comprises:

a radius of curvature of the riser bend is approximately 0.500 in (1.27 cm) to approximately 2.00 in (5.08 cm);

a height extending from the nose top section to the groove top bend is approximately 2.00 in (5.08 cm) to approximately 48.00 in (121.92 cm);

a height extending from the nose bottom section to the nose top section is approximately 0.500 to approximately 1.00 inch;

a width extending from the nose face section to the nose bottom edge is approximately 1.00 in (2.540 cm) to approximately 4.00 in (10.16 cm);

a width extending from the nose face section to the riser section is approximately 1.00 in (2.540 cm) to approximately 5.00 in (12.70 cm);

a height extending from the groove top bend to the groove bottom bend is approximately 0.200 in (0.508 cm) to approximately 2.00 in (5.08 cm);

a height extending from the groove bottom bend to a groove top edge at a distal end of the groove back section opposite the groove bottom bend is approximately 0.200 in (0.508 cm) to approximately 5.00 in (12.70 cm);

a width extending from the groove front section to the groove back section is approximately 0.024 in (0.0610 cm) to approximately 2.00 in (5.08 cm); and a thickness of the riser section is approximately 0.031 in (0.0610 cm) to approximately 0.060 in (0.1524 cm).

16. The method of claim 11, wherein:

forming the nose portion further comprises folding a nose top bend between the nose face section and a nose top section of the nose portion opposite the nose bottom section; and a height extending from the nose bottom section to the nose top section is approximately 0.69 in (1.753 cm) or approximately 0.74 in (1.880 cm).

17. The method of claim 11, wherein:

forming the wall groove portion further comprises folding a groove bottom bend between a groove front section of the wall groove portion and a groove back section of the wall groove portion; and a width extending from the groove front section to the groove back section is one of:

approximately 1/16 in (0.159 cm) to approximately 1/8 in (0.318 cm); or approximately 3/4 in (1.905 cm) to approximately 1.00 in (2.540 cm).

18. The method of claim 11, wherein:

forming the nose portion further comprises folding a nose top bend between the nose face section and a nose top section of the nose portion opposite the nose bottom section;

forming the wall groove portion further comprises folding a groove top bend between the riser section of the riser portion and a groove front section of the wall groove portion; and a height from the nose top section to the groove top bend is approximately 6 in (15.24 cm).

19. The method of claim 11, wherein:

forming the wall groove portion further comprises:

folding a groove top bend between the riser section of the riser portion and a groove front section of the wall groove portion; and folding a groove bottom bend between the groove front section and a groove back section of the wall groove portion; and a height extending from the groove top bend to the groove bottom bend is approximately 1.00 in (2.54 cm).

20. The method of claim 11, wherein:

the riser bend comprises a substantially arcuate shape; and a radius of curvature of the riser bend is at least approximately 1.00 in (2.54 cm).

* * * * *